US009000659B2

(12) United States Patent
Chin

(10) Patent No.: US 9,000,659 B2
(45) **Date of Patent: *Apr. 7, 2015**

(54) LAMP SOCKET

(71) Applicant: Kenneth S. Chin, Fremont, CA (US)

(72) Inventor: Kenneth S. Chin, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/084,623

(22) Filed: Nov. 20, 2013

(65) Prior Publication Data

US 2014/0073159 A1 Mar. 13, 2014

Related U.S. Application Data

(63) Continuation-in-part of application No. 13/178,449, filed on Jul. 7, 2011, now Pat. No. 8,593,050.

(60) Provisional application No. 61/483,849, filed on May 9, 2011.

(51) Int. Cl.

| | |
|---|---|
| ***H01J 5/48*** | (2006.01) |
| ***H01R 33/22*** | (2006.01) |
| ***H01J 5/56*** | (2006.01) |
| ***H01J 5/62*** | (2006.01) |
| ***H01J 61/32*** | (2006.01) |
| ***H01K 1/46*** | (2006.01) |
| ***H01R 33/94*** | (2006.01) |

(52) U.S. Cl.
CPC . *H01R 33/22* (2013.01); *H01J 5/56* (2013.01); *H01J 5/62* (2013.01); *H01J 61/327* (2013.01); *H01K 1/46* (2013.01); *H01R 33/94* (2013.01)

(58) Field of Classification Search
USPC ..... 313/318.04
See application file for complete search history.

(56) References Cited

U.S. PATENT DOCUMENTS

| | | | |
|---|---|---|---|
| 5,199,783 | A | 4/1993 | Pelton |
| 5,286,216 | A | 2/1994 | Volz |
| 5,463,540 | A | 10/1995 | Jones |
| 6,099,144 | A | 8/2000 | Klaus |
| 6,113,433 | A | 9/2000 | Al-Turki |
| 7,090,390 | B2 | 8/2006 | Pazula |
| 7,198,500 | B1 | 4/2007 | Lin |
| 7,748,886 | B2 | 7/2010 | Pazula et al. |
| 8,593,050 | B2 | 11/2013 | Chin |

OTHER PUBLICATIONS

U.S. Appl. No. 61/483,849, filed May 9, 2011, Unpublished.

*Primary Examiner* — Mary Ellen Bowman
(74) *Attorney, Agent, or Firm* — Patent Law Group LLP; David C. Hsia

(57) ABSTRACT

A lamp socket includes a first socket portion having a first diameter, and a second socket portion being concentric with the first socket portion and having a second diameter smaller than the first diameter.

18 Claims, 28 Drawing Sheets

LAMP SOCKET

CROSS-REFERENCE TO RELATED APPLICATIONS

This application is a continuation-in-part of U.S. Pat. No. 8,593,050, which claims the benefit of U.S. Provisional Application No. 61/483,849, filed May 9, 2011, which are incorporated herein by this reference.

FIELD OF INVENTION

This invention relates a lamp socket that has the form factor of a standard Edison lamp socket but works with energy efficient light bulbs with a compatible screw base and not with light bulbs with the standard Edison screw base.

DESCRIPTION OF RELATED ART

The Edison screw fitting is a system of light bulb connectors developed by Thomas Edison. Most have a right-hand threading so that it goes in when turned clockwise and comes out when turned counterclockwise.

SUMMARY

In one or more embodiments of the present disclosure, a lamp socket has the form factor of a standard Edison lamp socket but works with energy efficient light bulbs with a compatible screw base and not with light bulbs with the standard Edison screw base. This allows the lamp socket to be used in the manufacture of conventional light fixtures but qualify as high energy efficient light fixtures under California's Title 24 or similar lighting regulations from other governing bodies.

DETAILED DESCRIPTION OF THE INVENTION

Figure 1:
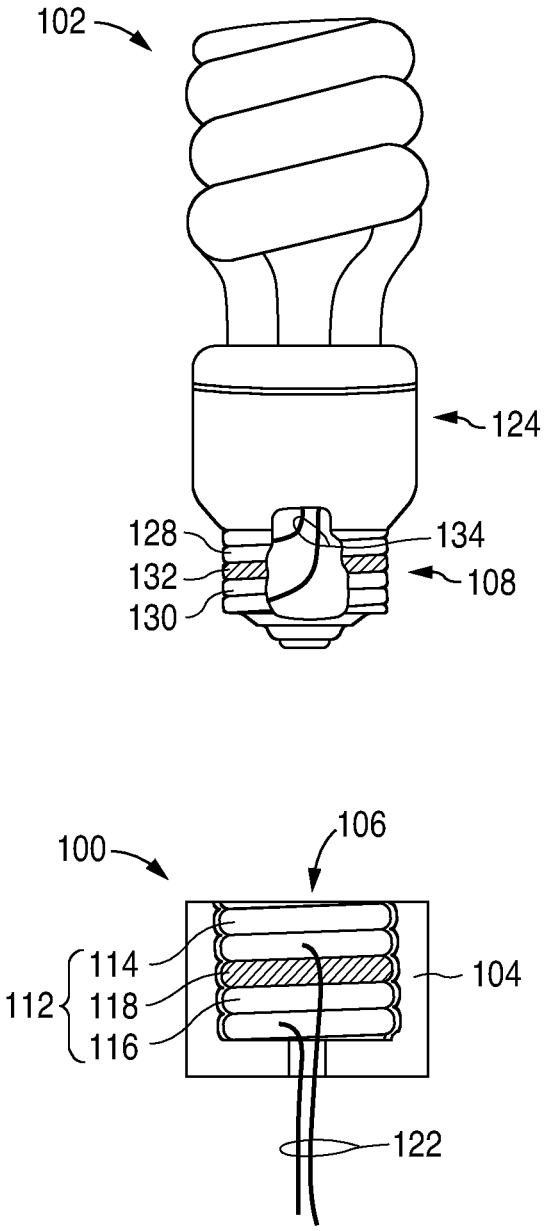
FIG. 1 shows cross-sectional and partial cutout views of a lamp socket and a compatible light bulb with their electrical contacts in a first side-side configuration.

FIG. 1 shows a lamp socket 100 and a compatible light bulb 102 with their electrical contacts in a first side-side configuration in one or more embodiments of the present disclosure. Lamp socket 100, shown in cross-sectional, may have an external form factor similar to a standard Edison lamp socket so it may be used in existing designs of light fixtures. Lamp socket 100 includes a nonconductive housing 104 that defines a cylindrical cavity 106 for receiving a screw base 108 of light bulb 102. In one embodiment, an internally threaded socket sleeve 112 is located in cavity 106 for engaging screw base 108. Socket sleeve 112 includes an upper conductive portion 114 and a lower conductive portion 116 insulated from each other by a non-conductive portion 118. Portions 114 and 116 serve as electrical contacts to screw base 108. Alternatively, cavity 106 is internally threaded for engaging screw base 108, and electrical contacts 114, 116 are conductive tabs located on the internal threads. Electrical contacts 114 and 116 are connected to electrical lines 122 out of lamp socket 100.

Light bulb 102, shown with a partial cutaway, includes a light source 124 and screw base 108 below the light source. Light source 124 meets the high-efficacy standards of California's Title 24 or similar lighting regulations from other governing bodies. Light source 124 may be a light-emitting diode, a fluorescent light source, or another energy efficient light source. Screw base 108 may have the dimensions of a standard Edison screw base. Screw base 108 includes an upper conductive portion 128 and a lower conductive portion 130 insulated from each other by a non-conductive portion 132. Portions 128 and 130 serve as electrical contacts to lamp socket 100. Lead wires 134 from light source 124 are connected to electrical contacts 128 and 130.

Light bulb 102 is screwed into lamp socket 100 in a normal fashion so the corresponding electrical contacts would touch so light bulb 102 can work. When a conventional light bulb with a standard Edison screw base is screwed into lamp socket 100, the electrical contacts would not touch so the conventional light bulb cannot operate. Thus, a light fixture using lamp socket 100 would qualify as a high energy efficient light fixture.

Figure 2A:
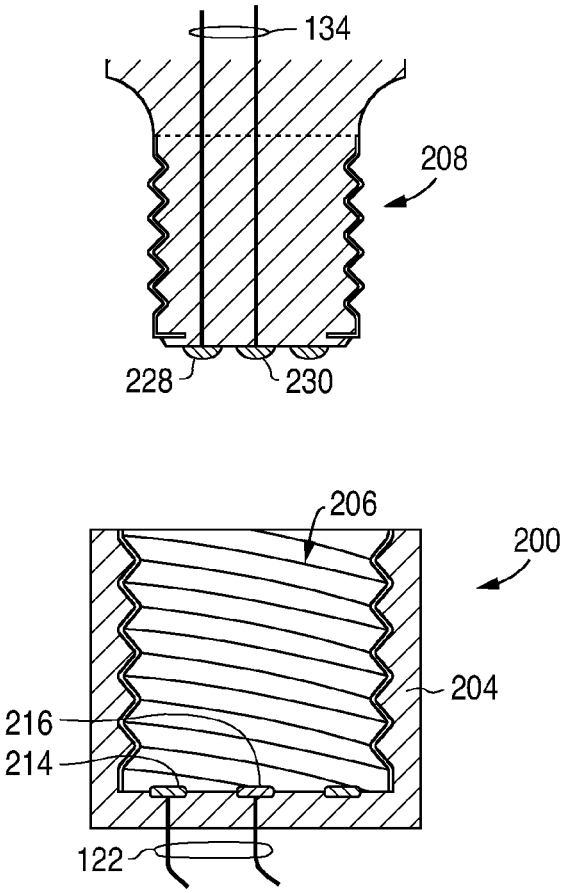
FIG. 2A shows a cross-sectional view of a lamp socket and a compatible screw base with their electrical contacts in a bottom-bottom configuration.
Figure 2B:
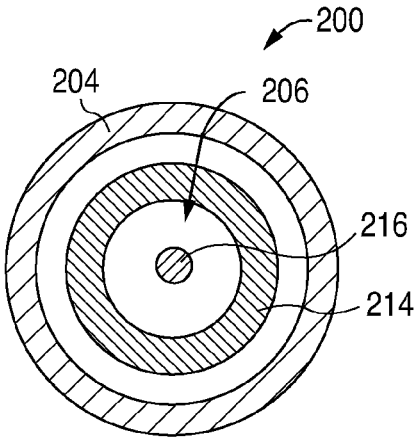
FIG. 2B shows a top view of the lamp socket of FIG. 2A.

FIG. 2A shows a cross-sectional view of a lamp socket 200 and a compatible screw base 208 with their electrical contacts in a bottom-bottom configuration in one or more embodiments of the present disclosure. Lamp socket 200 may have the general form factor of a standard Edison lamp socket so it may be used in existing designs of light fixtures. Lamp socket 200 includes a nonconductive housing 204 that defines a cylindrical cavity 206 for receiving screw base 208 of a light bulb. Cavity 206 is internally threaded for engaging screw base 208. As FIG. 2B shows in a top view, an outer annular electrical contact 214 and an inner circular electrical contact 216 are located on the floor of cavity 206 of housing 204. Referring back to FIG. 2A, electrical contacts 214 and 216 are connected to electrical lines 122 out of lamp socket 100.

Similar to light bulb 102 (FIG. 1), screw base 208 is part of a light bulb that has an energy efficient light source above the screw base. Screw base 208 may have the dimensions of a standard Edison screw base. The bottom of screw base 208 includes an outer annular electrical contact 228 and an inner circular electrical contact 230. Lead wires 134 from the light source are connected to contacts 228 and 230.

When a conventional light bulb with a standard Edison screw base is screwed into lamp socket 200, the electrical contacts would not touch so the conventional light bulb cannot operate. Thus, a light fixture using lamp socket 200 would qualify as a high energy efficient light fixture.

Figure 3:
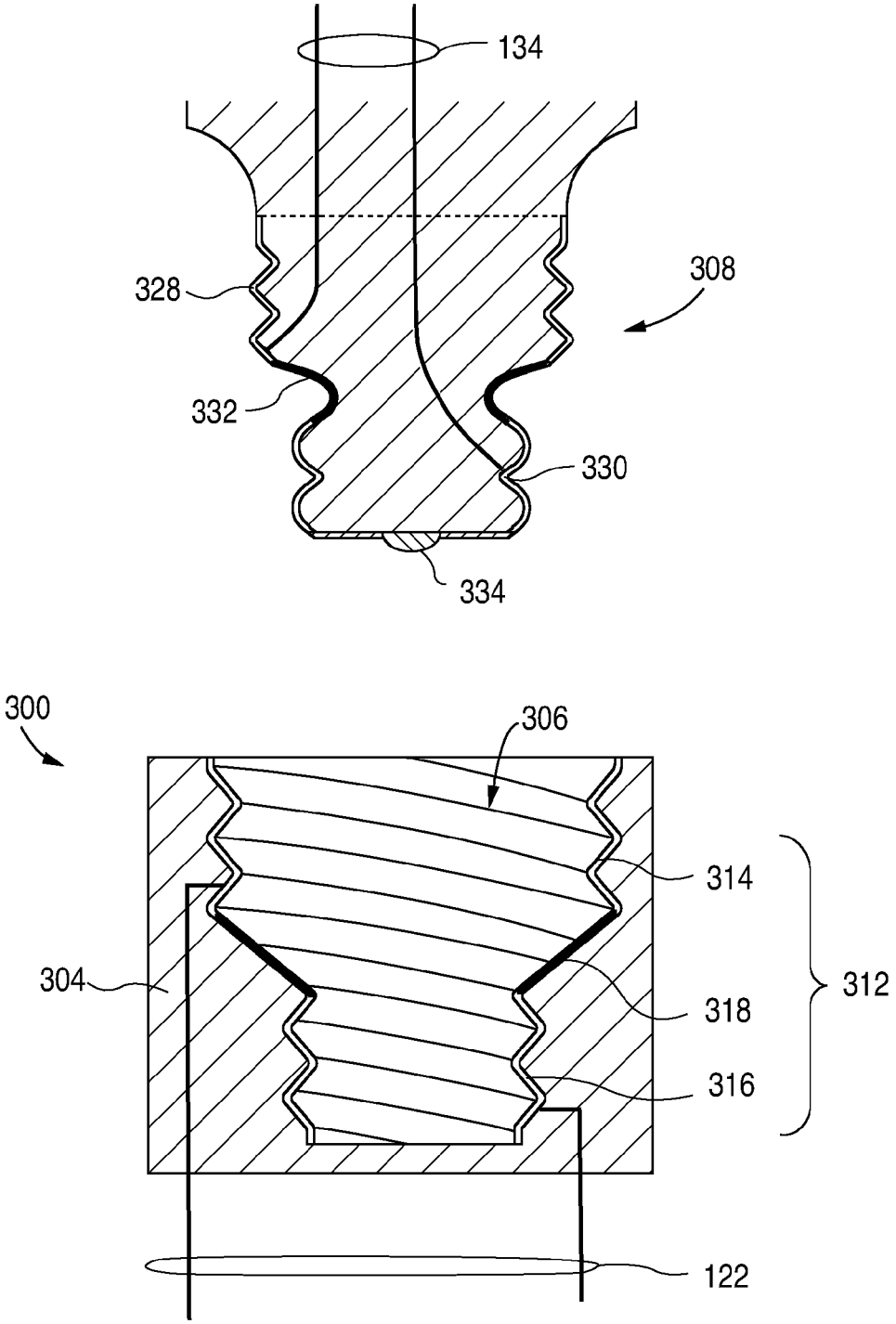
FIG. 3 shows a cross-sectional view of a lamp socket and a compatible screw base with their electrical contacts in a second side-side configuration.

FIG. 3 shows a cross-sectional view of a lamp socket 300 and a compatible screw base 308 with their electrical contacts in a second side-side configuration in one or more embodiments of the present disclosure. Lamp socket 300 may have the general form factor of a standard Edison lamp socket so it may be used in existing designs of light fixtures. Lamp socket 300 includes a nonconductive housing 304 that defines a cavity 306 for receiving screw base 308 of a light bulb. In one embodiment, an internally threaded socket sleeve 312 is located in cavity 306 for engaging screw base 308. Socket sleeve 312 includes an upper conductive portion 314 and a lower conductive portion 316 insulated from each other by a non-conductive portion 318 that narrows from portion 314 to portion 316. Portion 314 has internal threads of a first diameter and portion 316 has internal threads of a second, smaller diameter. Portion 314 may have the diameter and threads of a standard Edison lamp socket. Portions 314 and 316 serve as electrical contacts to screw base 308. Alternatively, cavity 306 is internally threaded with an upper portion of the first diameter and a lower portion with the second diameter, and electrical contacts 314, 316 are conductive tabs located on the upper, lower portions of the internal threads. Electrical contacts 314 and 316 are connected to electrical lines 122 out of lamp socket 300.

Similar to light bulb 102 (FIG. 1), screw base 308 is part of a light bulb that has an energy efficient light source above the screw base. Screw base 308 includes an upper conductive portion 328 of the first diameter and a lower conductive portion contact 330 of the second diameter. Portions 328 and 330 are insulated from each other by a non-conductive portion 332. Portions 328 and 330 serve as electrical contacts to lamp socket 300. Electrical contact 330 may have the diameter and threads of a standard Edison screw base. In one or more embodiments, electrical contact 330 may include the bottom portion 334 of screw base 308 to make the light bulb compatible with the standard Edison lamp socket. Lead wires 134 from the light source are connected to contacts 328 and 330.

When a conventional light bulb with a standard Edison screw base is screwed into lamp socket 300, the electrical contacts would not touch so the conventional light bulb cannot operate. Thus, a light fixture using lamp socket 300 would qualify as a high energy efficient light fixture.

Figure 4:
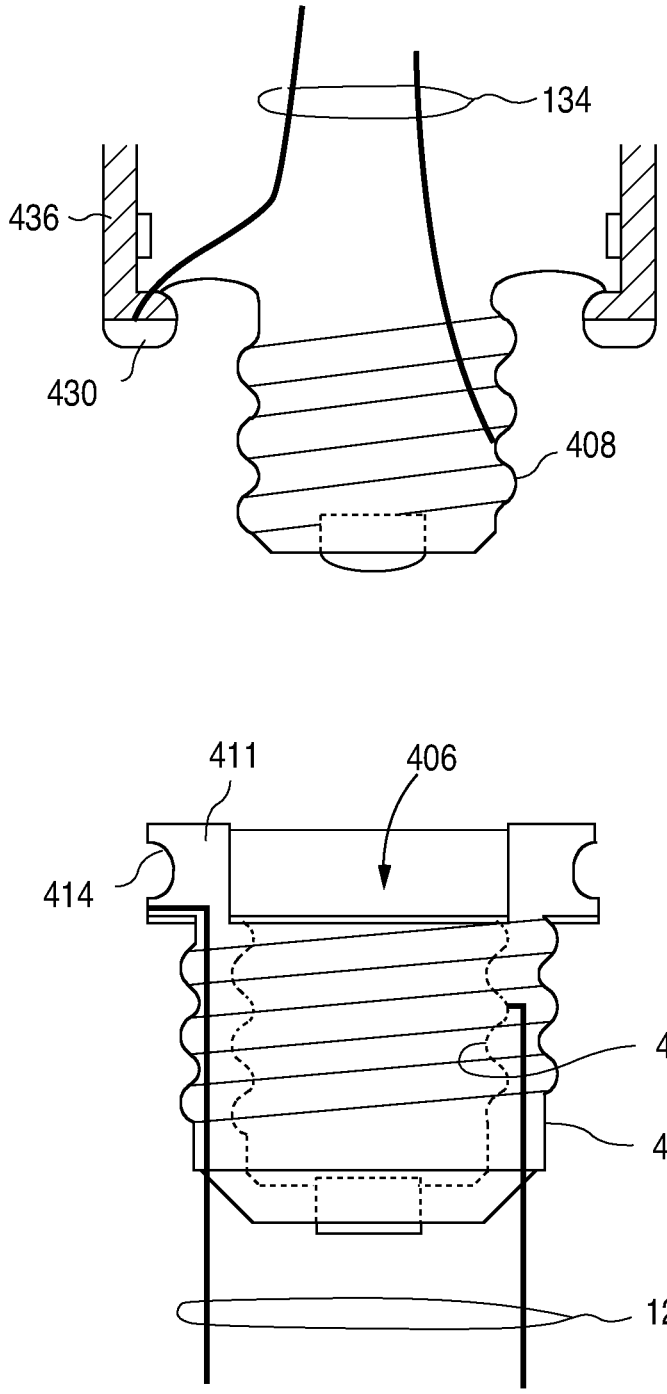
FIG. 4 shows a cross-sectional view of a lamp socket and a compatible screw base with their electrical contacts in a top-side configuration.

FIG. 4 shows a cross-sectional view of a lamp socket 400 and a compatible screw base 408 with their electrical contacts in a top-side configuration in one or more embodiments of the present disclosure. Lamp socket 400 may have the general form factor of a standard Edison lamp socket so it may be used in existing designs of light fixtures. Lamp socket 400 includes a nonconductive housing 404 that defines a cavity 406 for receiving screw base 408 of a light bulb. Lamp socket 400 further includes an annular top 411 above housing 404. Annular top 411 has external threads 414. In one embodiment, annular top 411 is conductive and serves as an electrical contact to screw base 408. Alternatively a conductive tab is located on the external threads of a nonconductive annular top 411 and serves as the electrical contact. In one embodiment, an internally threaded socket sleeve 416 is located in cavity 406 and serves as an electrical contact to screw base 408. Alternatively, cavity 406 is internally threaded for engaging screw base 408, and a conductive tab located on the internal threads of cavity 406 serves as the electrical contact. Electrical contacts 414 and 416 are connected to electrical lines 122 out of lamp socket 400.

Similar to light bulb 102 (FIG. 1), screw base 408 is part of a light bulb that has an energy efficient light source above the screw base. Screw base 408 is conductive and forms an electrical contact to lamp socket 400. Screw base 408 is located below a nonconductive housing 436 for the light source. The lower open end of housing 436 has internal threads for engaging the external threads of annular top 411 of lamp socket 400. An electrical contact 430 is formed on the bottom thread. Lead wires 134 from the light source are connected to electrical contacts 408 and 430.

When a conventional light bulb with a standard Edison screw base is screwed into lamp socket 400, the electrical contacts would not touch so the conventional light bulb cannot operate. Thus, a light fixture using lamp socket 400 would qualify as a high energy efficient light fixture.

Figure 5:
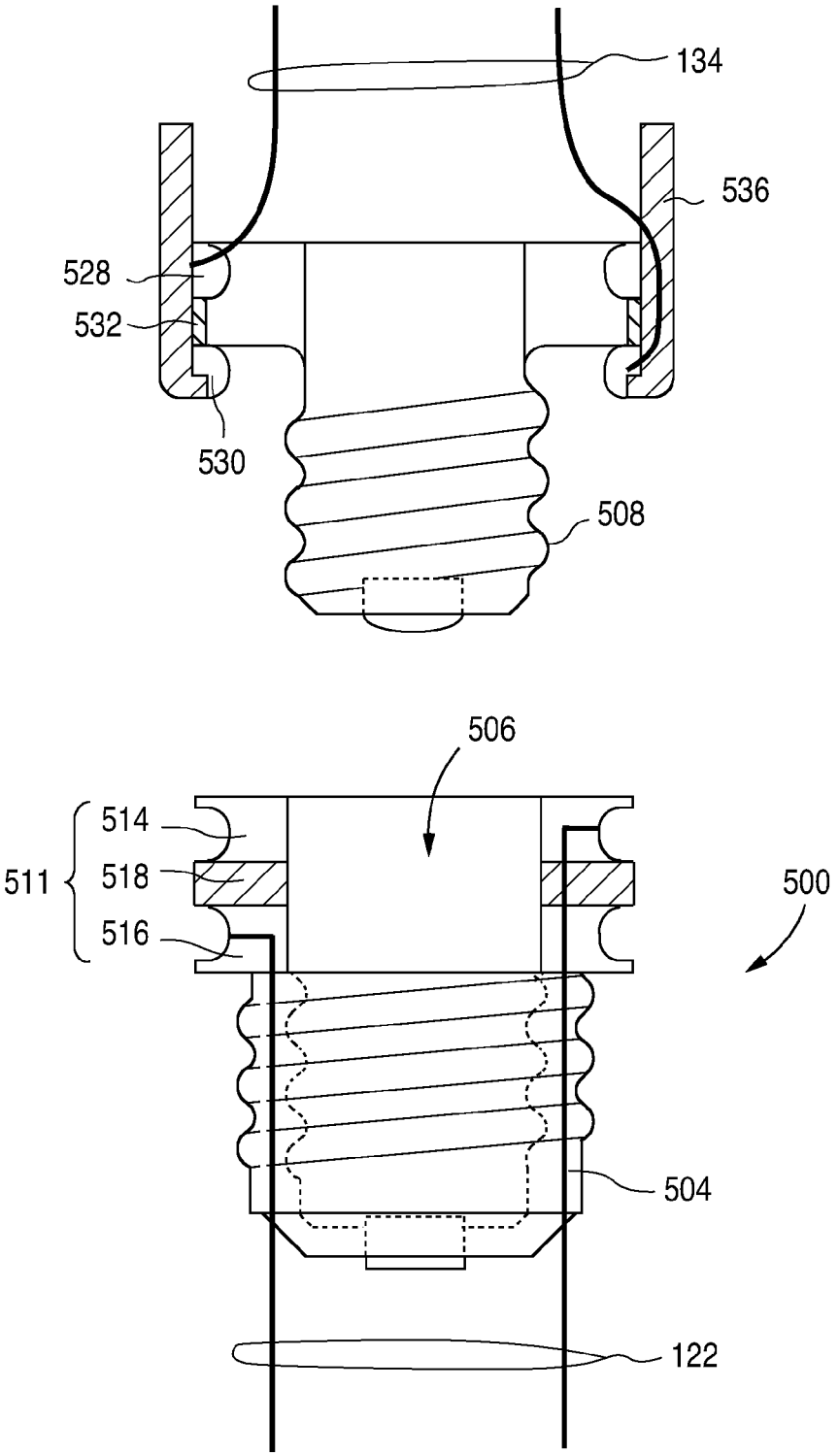
FIG. 5 shows a cross-sectional view of a lamp socket and a compatible screw base with their electrical contacts in a top-top configuration.

FIG. 5 shows a cross-sectional view of a lamp socket 500 and a compatible screw base 508 with their electrical contacts in a top-top configuration in one or more embodiments of the present disclosure. Lamp socket 500 may have the general form factor of a standard Edison lamp socket so it may be used in existing designs of light fixtures. Lamp socket 500 includes a nonconductive housing 504 that defines a cavity 506 for receiving screw base 508 of a light bulb. Lamp socket 500 further includes an annular top 511 above housing 504. Annular top 511 is externally threaded and includes an upper conductive portion 514 and a lower conductive portion 516 insulated from each other by a non-conductive portion 518. Portions 514 and 516 serve as electrical contacts to screw base 508. Alternatively conductive tabs are located on the external threads of a nonconductive annular top 511 and serve as the electrical contacts. Electrical contacts 514 and 516 are connected to electrical lines 122 out of lamp socket 500.

Similar to light bulb 102 (FIG. 1), screw base 508 is part of a light bulb that has an energy efficient light source above the screw base. Screw base 508 is conductive and forms an electrical contact to lamp socket 500. Screw base 508 is located below a nonconductive housing 536 for the light source. The lower open end of housing 536 is internally threaded and includes an upper conductive portion 528 and a lower conductive portion 530 insulated from each other by a non-conductive portion 532. Portions 528 and 530 serve as electrical contacts to lamp socket 500. Alternatively conductive tabs are located on the internal threads of housing 536 and serve as the electrical contacts. Lead wires 134 from the light source are connected to electrical contacts 528 and 530.

When a conventional light bulb with a standard Edison screw base is screwed into lamp socket 500, the electrical contacts would not touch so the conventional light bulb cannot operate. Thus, a light fixture using lamp socket 500 would qualify as a high energy efficient light fixture.

Figure 6:
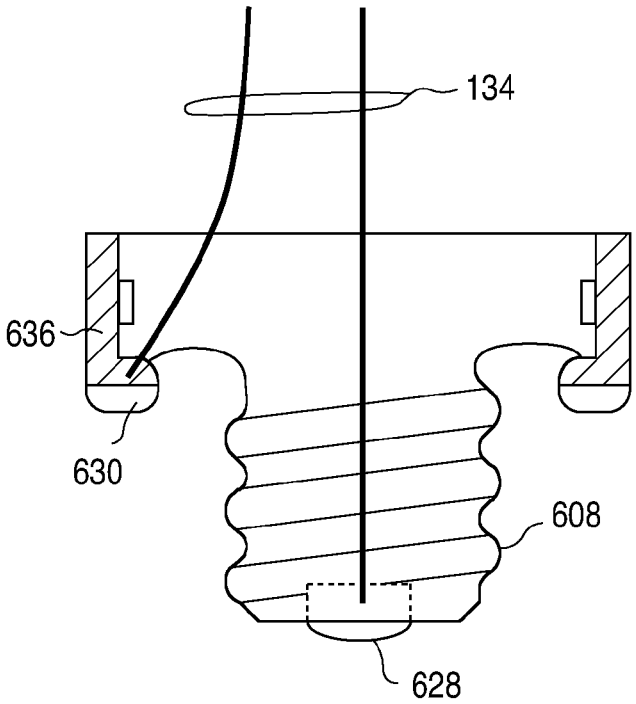
FIG. 6 shows a cross-sectional view of a lamp socket and a compatible screw base with their electrical contacts in a top-bottom configuration.
Figure 6:
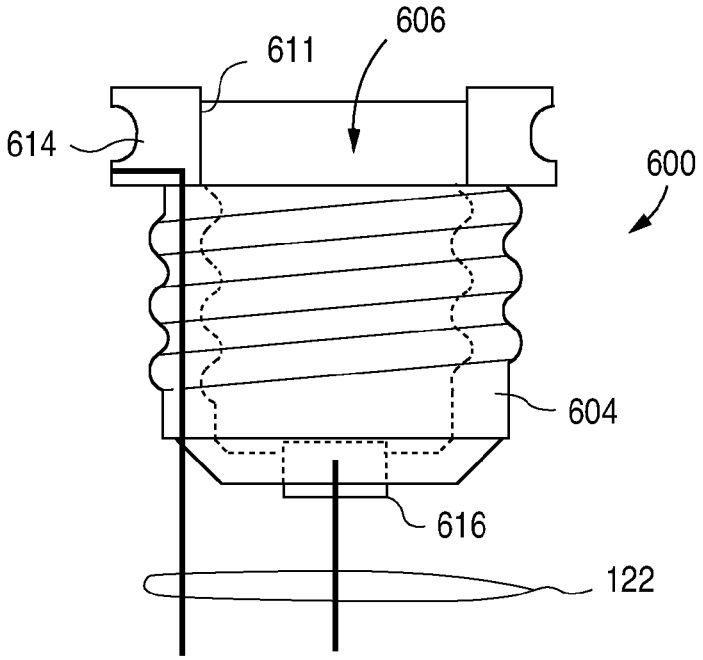

FIG. 6 shows a cross-sectional view of a lamp socket 600 and a compatible screw base 608 with their electrical contacts in a top-bottom configuration in one or more embodiments of the present disclosure. Lamp socket 600 may have the general form factor of a standard Edison lamp socket so it may be used in existing designs of light fixtures. Lamp socket 600 includes a nonconductive housing 604 that defines a cavity 606 for receiving screw base 608 of a light bulb. Lamp socket 600 further includes an annular top 611 above housing 604. Annular top 611 has external threads 614. In one embodiment, annular top 611 is conductive and serves as an electrical contact to screw base 608. Alternatively, a conductive tab is located on the external threads of a nonconductive annular top 611 and serves as the electrical contact. Cavity 606 is internally threaded for engaging screw base 608, and an electrical contact 616 is located on the floor of cavity 606. Electrical contacts 614 and 616 are connected to electrical lines 122 out of lamp socket 600.

Similar to light bulb 102 (FIG. 1), screw base 608 is part of a light bulb that has an energy efficient light source above the screw base. The bottom 628 of screw base 608 is conductive and forms an electrical contact to lamp socket 600. Screw base 608 is located below a nonconductive housing 636 for the light source. The lower open end of housing 636 has internal threads for engaging the external threads of annular top 611 of lamp socket 600. An electrical contact 630 is formed on the bottom thread. Lead wires 134 from the light source are connected to electrical contacts 628 and 630.

When a conventional light bulb with a standard Edison screw base is screwed into lamp socket 600, the electrical contacts would not touch so the conventional light bulb cannot operate. Thus, a light fixture using lamp socket 600 would qualify as a high energy efficient light fixture.

Figure 7:
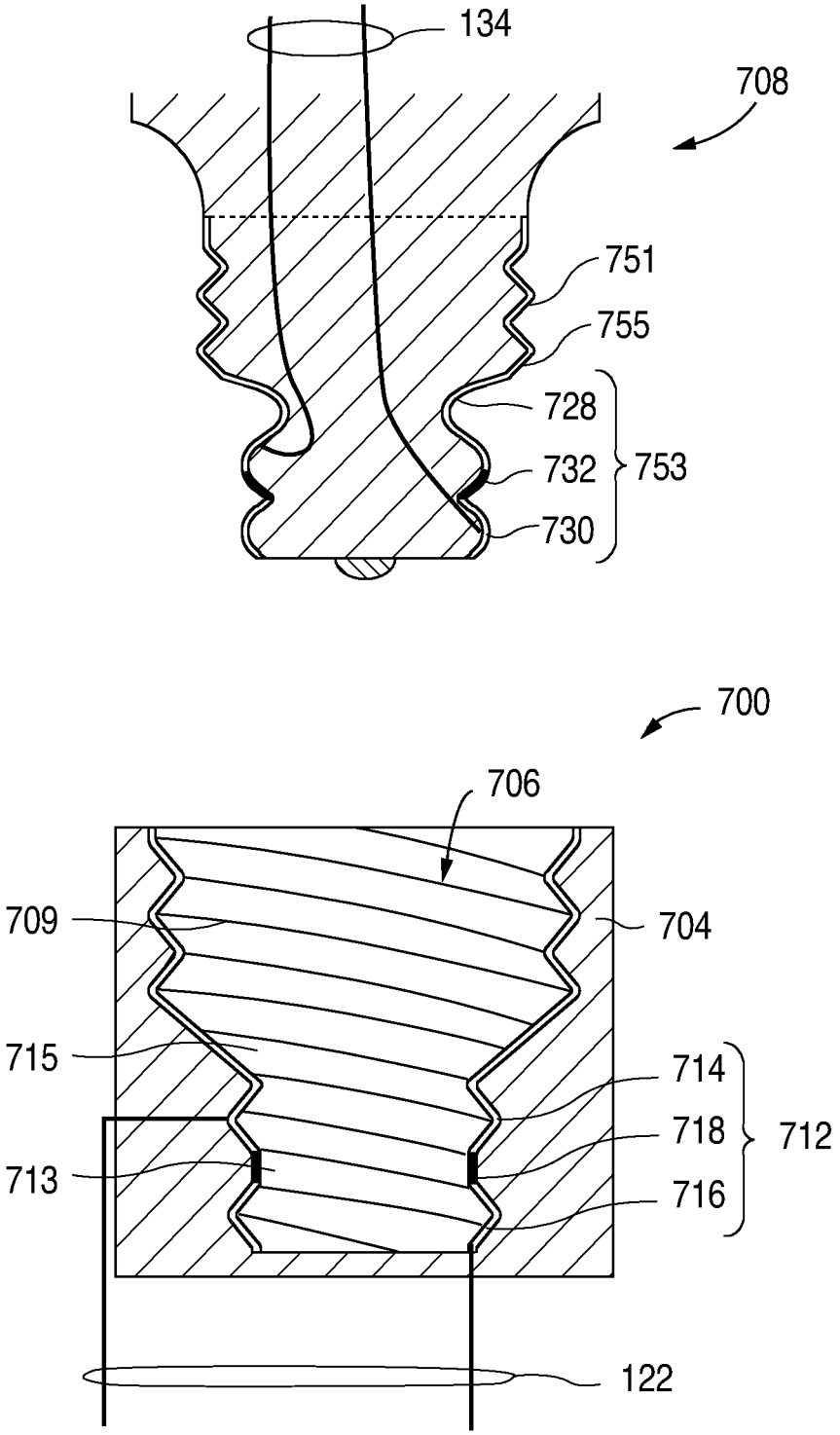
FIG. 7 shows a cross-sectional view of a lamp socket and a compatible screw base with their electrical contacts in a third side-side configuration.

FIG. 7 shows a cross-sectional view of a lamp socket 700 and a compatible screw base 708 with their electrical contacts in a third side-side configuration in one or more embodiments of the present disclosure. Lamp socket 700 may have the general form factor of a standard Edison lamp socket so it may be used in existing designs of light fixtures. Lamp socket 700 includes a nonconductive housing 704 that defines a cavity 706 for receiving screw base 708 of a light bulb. Cavity 706 includes an upper portion 709 of a first diameter, a lower portion 713 of a second, smaller diameter, and a neck portion 715 joining portions 709 and 713. Portion 709 may have the diameter and threads of a standard Edison lamp socket. In one embodiment, an internally threaded socket sleeve 712 is located in lower portion 713. Socket sleeve 712 includes an upper conductive portion 714 and a lower conductive portion 716 insulated from each other by a non-conductive portion 718. Portions 714 and 716 serve as electrical contacts to screw base 708. Alternatively, electrical contacts 714 and 716 are conductive tabs located on the internal threads. Electrical contacts 714 and 716 are connected to electrical lines 122 out of lamp socket 700.

Similar to light bulb 102 (FIG. 1), screw base 708 is part of a light bulb that has an energy efficient light source above the screw base. Screw base 708 includes of an upper portion 751 of the first diameter, a lower narrow portion 753 of the second diameter, and a narrowing neck portion 755 joining portions 751 and 753. Upper portion 751 may have the diameter and threads of a standard Edison screw base. Lower portion 753 includes an upper conductive portion 728 and a lower conductive portion 730. Portions 728 and 730 are insulated from each other by a non-conductive portion 732. Portions 728 and 730 serve as electrical contacts to lamp socket 700. Lead wires 134 from the light source are connected to contacts 728 and 730.

When a conventional light bulb with a standard Edison screw base is screwed into lamp socket 700, the electrical contacts would not touch so the conventional light bulb cannot operate. Thus, a light fixture using lamp socket 700 would qualify as a high energy efficient light fixture.

Figure 8:
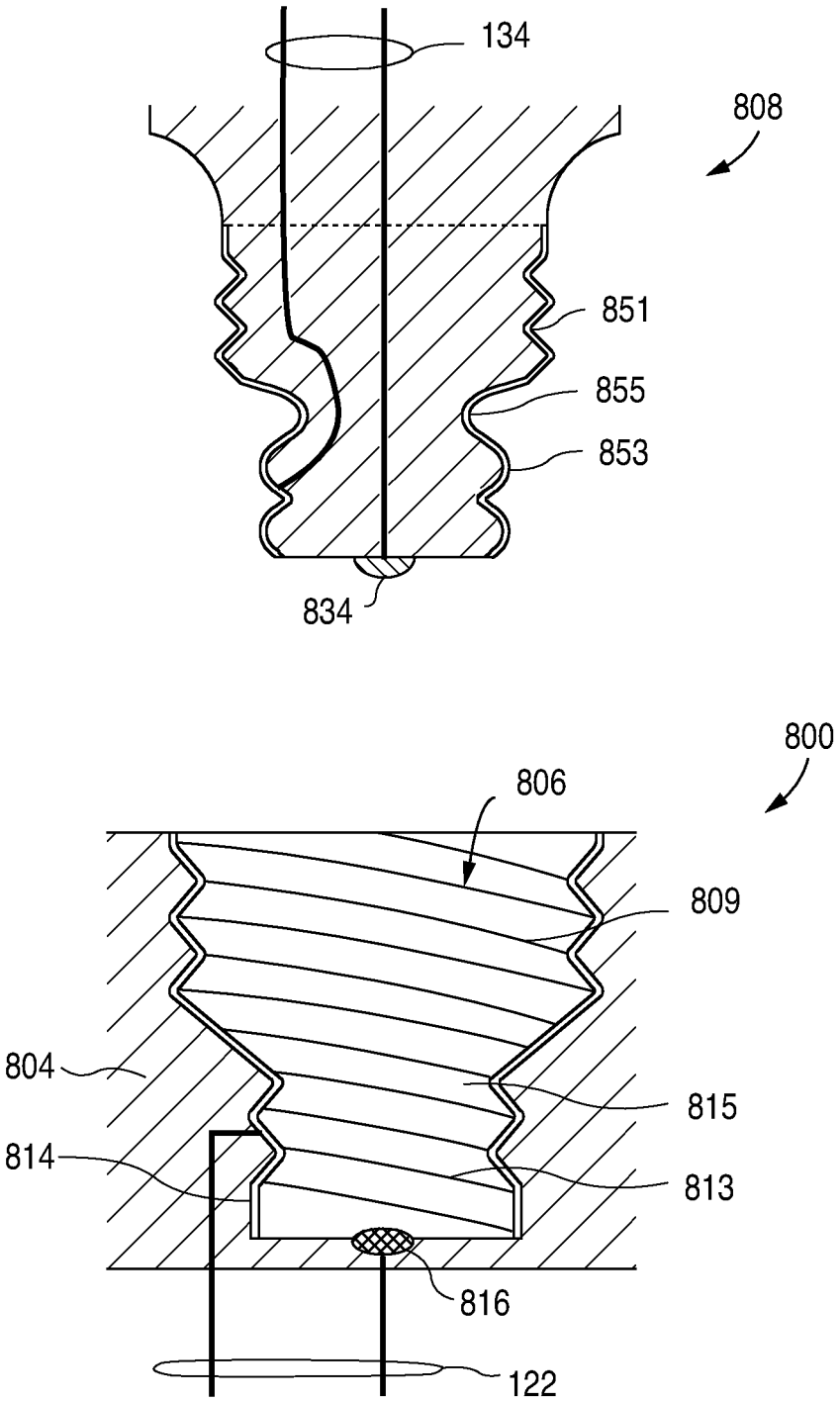
FIG. 8 shows a cross-sectional view of a lamp socket and a compatible screw base with their electrical contacts in a first side-bottom configuration.

FIG. 8 shows a cross-sectional view of a lamp socket 800 and a compatible screw base 808 with their electrical contacts in a first side-bottom configuration in one or more embodiments of the present disclosure. Lamp socket 800 may have the general form factor of a standard Edison lamp socket so it may be used in existing designs of light fixtures. Lamp socket 800 includes a nonconductive housing 804 that defines a cavity 806 for receiving screw base 808 of a light bulb. Cavity 806 includes an upper portion 809 of a first diameter, a lower portion 813 of a second, smaller diameter, and a neck portion 815 joining portions 809 and 813. Portion 809 may have the diameter and threads of a standard Edison lamp socket. In one embodiment, an internally threaded socket sleeve 814 is located in lower portion 813. Socket sleeve 814 serves as an electrical contact to screw base 808. Alternatively, electrical contact 814 is a conductive tab located on the internal threads. An electrical contact 816 is located on the bottom of cavity 806. Electrical contacts 814 and 816 are connected to electrical lines 122 out of lamp socket 800.

Similar to light bulb 102 (FIG. 1), screw base 808 is part of a light bulb that has an energy efficient light source above the screw base. Screw base 808 includes an upper portion 851 of the first diameter, a lower narrow portion 853 of the second diameter, and a narrowing neck portion 855 joining portions 851 and 853. Portion 851 may have the diameter and threads of a standard Edison screw base. Portion 853 serves as an electrical contact to lamp socket 800. An electrical contact 834 is located at the bottom of screw base 808. Electrical contact 834 is insulated from portion 853 by the surrounding material. Lead wires 134 from the light source are connected to electrical contacts 834 and 853.

When a conventional light bulb with a standard Edison screw base is screwed into lamp socket 800, the electrical contacts would not touch so the conventional light bulb cannot operate. Thus, a light fixture using lamp socket 800 would qualify as a high energy efficient light fixture.

Figure 9:
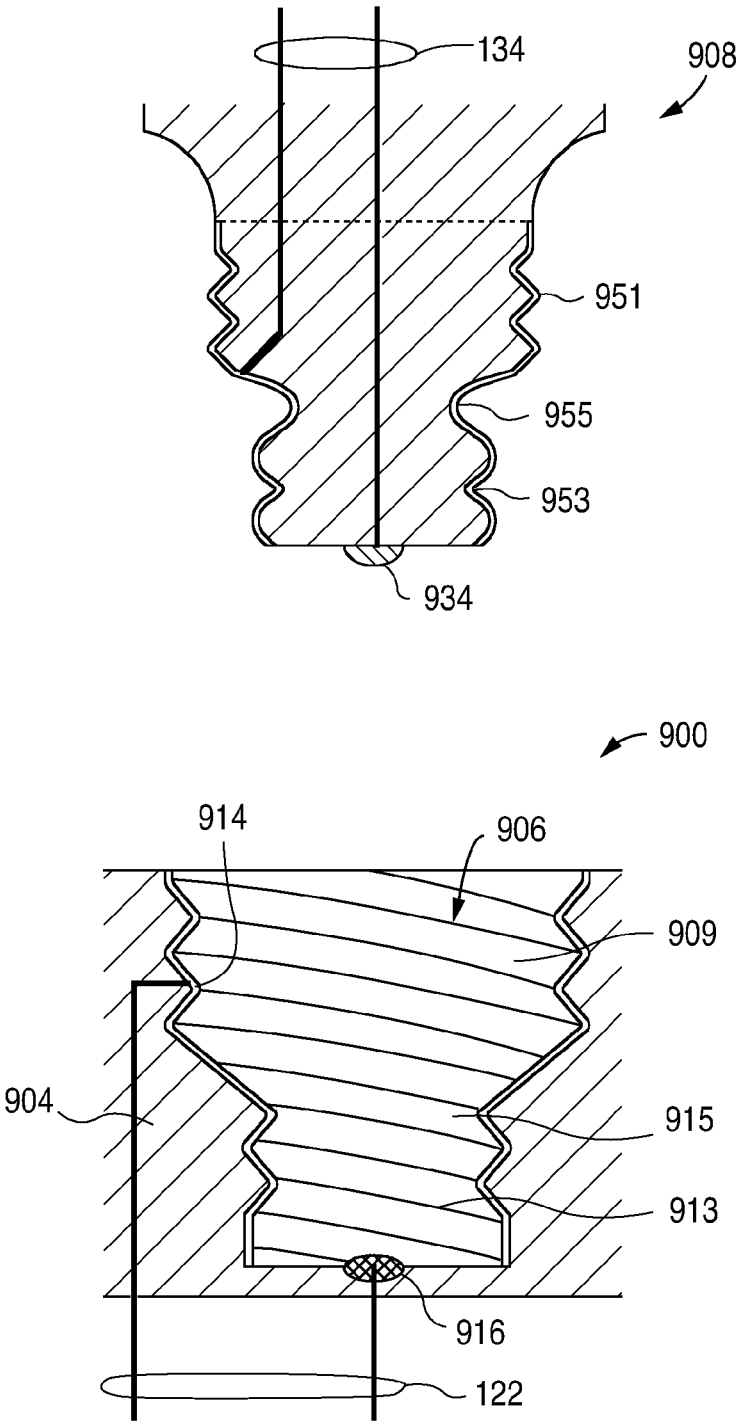
FIG. 9 shows a cross-sectional view of a lamp socket and a compatible screw base with their electrical contacts in a second side-bottom configuration.

FIG. 9 shows a cross-sectional view of a lamp socket 900 and a compatible screw base 908 with their electrical contacts in a second side-bottom configuration in one or more embodiments of the present disclosure. Lamp socket 900 may have the general form factor of a standard Edison lamp socket so it may be used in existing designs of light fixtures. Lamp socket 900 includes a nonconductive housing 904 that defines a cavity 906 for receiving screw base 908 of a light bulb. Cavity 906 includes an upper portion 909 of a first diameter, a lower portion 913 of a second diameter smaller than the first diameter, and a neck portion 915 joining portions 909 and 913. Portion 909 may have the diameter and threads of a standard Edison lamp socket. In one embodiment, an internally threaded socket sleeve 914 is located in upper portion 909. Socket sleeve 914 serves as an electrical contact to screw base 908. Alternatively, electrical contact 914 is a conductive tab located on the internal threads. An electrical contact 916 is located on the bottom of cavity 906. Electrical contacts 914 and 916 are connected to electrical lines 122 out of lamp socket 900.

Similar to light bulb 102 (FIG. 1), screw base 908 is part of a light bulb that has an energy efficient light source above the screw base. Screw base 908 includes an upper portion 951 of the first diameter, a lower narrow portion 953 of the second diameter, and a narrowing neck portion 955 joining portions 951 and 953. Portion 951 may have the diameter and threads of a standard Edison screw base. Portion 951 serves as an electrical contact to lamp socket 900. An electrical contact 934 is located at the bottom of screw base 908. Electrical contact 934 is insulated from portion 951 by the surrounding material. Lead wires 134 from the light source are connected to electrical contacts 934 and 951.

When a conventional light bulb with a standard Edison screw base is screwed into lamp socket 900, the electrical contacts would not touch so the conventional light bulb cannot operate. Thus, a light fixture using lamp socket 900 would qualify as a high energy efficient light fixture.

Figure 10:
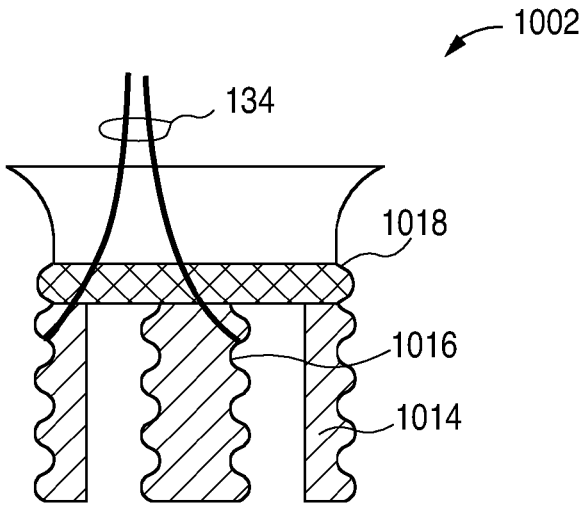
FIG. 10 shows a cross-sectional view of a lamp double socket 1000 and a compatible double screw base 1002 with their electrical contacts in an inner-outer configuration.
Figure 10:
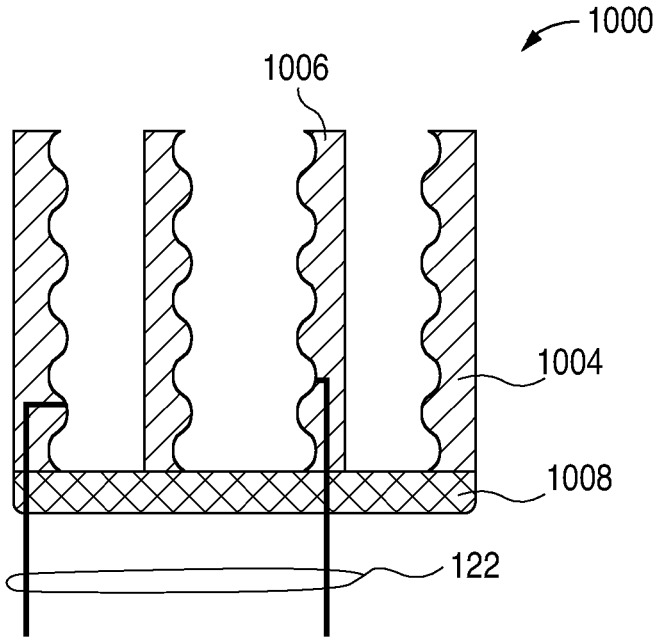

FIG. 10 shows a cross-sectional view of a lamp assembly having a lamp double socket 1000 and a compatible double screw base 1002 with their electrical contacts in an inner-outer configuration in one or more embodiments of the present disclosure. Double socket 1000 may have the general form factor of a standard Edison lamp socket so it may be used in existing designs of light fixtures. Double socket 1000 includes an outer socket 1004 and an inner socket 1006 located within the outer socket. Sockets 1004 and 1006 are concentrically seated on a socket base 1008. Sockets 1004 and 1006 are generally cylindrical and have conductive internal threads that serve as first and second electrical contacts to double screw base 1002.

Each socket may be entirely conductive or consist of a conductive screw shell within a nonconductive shell. Alternatively sockets 1004 and 1006 have nonconductive internal threads and conductive tabs on the internal threads that serve as the first and the second electrical contacts. Socket base 1008 may be entirely nonconductive or consist of a nonconductive body with electrical connections from sockets 1004 and 1006 to terminal screws. The first and the second electrical contacts are connected directly or coupled indirectly to electrical lines 122 out of double socket 1000. For example, electrical lines 122 pass through socket base 1008 and sockets 1004, 1006 to make direct contact with the conductive internal threads. Alternatively, electrical lines 122 are connected to the terminal screws of a socket base 1008 electrically connected to sockets 1004 and 1006.

Socket 1004 has a first diameter and socket 1006 has a second, smaller diameter. Socket 1004 may have the diameter and threads of a larger standard Edison lamp socket, such as a medium or standard E26 socket. Socket 1006 may have the diameter and threads of a smaller standard Edison lamp socket, such as a candelabra E12 socket.

Similar to light bulb 102 (FIG. 1), double screw base 1002 is part of a light bulb that has an energy efficient light source above the screw base. Double screw base 1002 includes an outer screw base 1014 with an open end and an inner screw base 1016 located within the outer screw base. Screw bases 1014 and 1016 are concentrically seated on a base 1018. Screw bases 1014 and 1016 are generally cylindrical and have conductive external threads that match the internal threads of sockets 1004, 1006 and serve as third and fourth electrical contacts to double screw base 1002.

Each screw base may be entirely conductive or consist of a conductive screw sleeve around a nonconductive shell. Alternatively screw bases 1014 and 1016 have nonconductive external threads and conductive tabs on the external threads that serve as the third and the fourth electrical contacts. Lead wires 134 from the light source are connected directly or coupled indirectly to the third and the fourth electrical contacts. For example, lead wires 134 pass through base 1018 and screw bases 1014, 1016 to make direct contact with the conductive external threads.

Screw base 1014 has a first diameter and screw base 1016 has a second, smaller diameter. Screw base 1014 may have the diameter and threads of a larger standard Edison screw base, such as a medium or standard E26 screw base. Screw base 1016 may have the diameter and threads of a smaller standard Edison screw base, such as a candelabra E12 screw base.

A light bulb with double screw base 1002 is screwed into double socket 1000 in a normal fashion so the first and the third electrical contacts would touch, and the second and the fourth electrical contacts would touch. As a conventional light bulb with a standard Edison screw base cannot be screwed into double socket 1000, a light fixture using the double socket would qualify as a high energy efficient light fixture.

Figure 11:
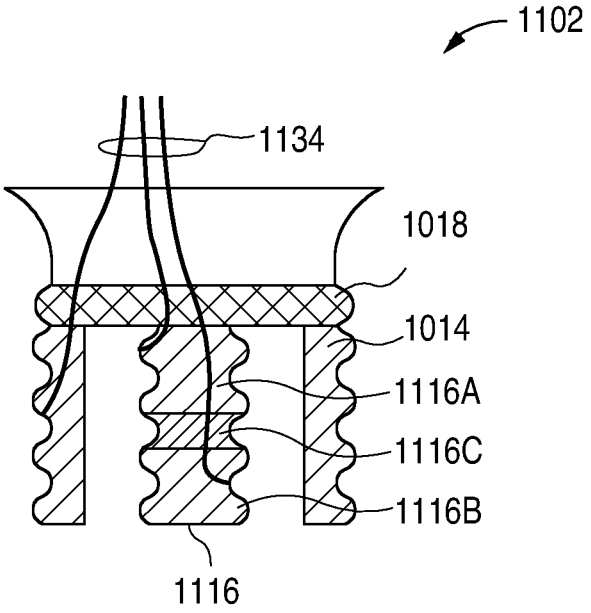
FIG. 11 shows a cross-sectional view of a lamp double socket and a compatible double screw base with their electrical contacts in a double inner-single outer configuration.
Figure 11:
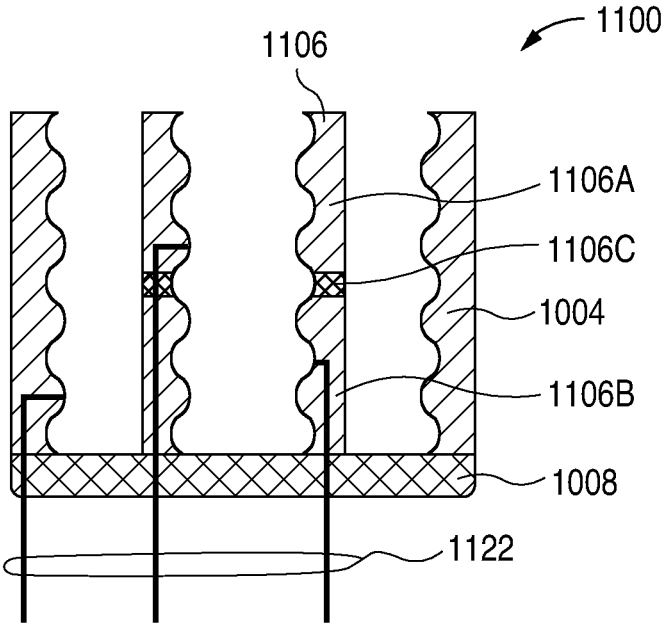

FIG. 11 shows a cross-sectional view of a lamp assembly having a lamp double socket 1100 and a compatible double screw base 1102 with their electrical contacts in a double inner-single outer configuration in one or more embodiments of the present disclosure. Double socket 1100 is similar to double socket 1000 (FIG. 10) except inner socket 1006 (FIG. 10) has been replaced by an inner socket 1106. Socket 1106 has similar dimensions as socket 1006. Socket 1106 includes internal threads with a conductive upper portion 1106A and a conductive lower portion 1106B insulated from each other by a non-conductive middle portion 1106C. The conductive internal threads of socket 1004, conductive internal thread portion 1106A, and conductive internal thread portion 1106B serve as first, second, and third electrical contacts to double screw base 1102. The three electrical contacts are connected directly or coupled indirectly to electrical lines 1122 out of double socket 1100. The three electrical contacts allows double socket 1100 to be used with three-way bulbs or with relays for three-way switching. Depending on the application, less than all the contacts may be utilized.

Double screw base 1102 is similar to double screw base 1002 (FIG. 10) except inner screw base 1016 (FIG. 10) has been replaced by an inner screw base 1116. Screw base 1116 has similar dimensions as screw base 1016. Screw base 1116 includes external threads with a conductive upper portion 1116A and a conductive lower portion 1116B insulated from each other by a non-conductive middle portion 1116C. The conductive external threads of screw base 1014, conductive external thread portion 1116A, and conductive external thread portion 1116B serve as fourth, fifth, and sixth electrical contacts to double socket 1100. Lead wires 1134 from the light source are connected directly or coupled indirectly to the three electrical contacts. Lead wires 1134 are connected to the light source according to the purpose of the application, such as providing a three-way bulb or three-way switching. Depending on the application, less than all the contacts may be utilized.

A light bulb with double screw base 1102 is screwed into double socket 1100 in a normal fashion so the first and the fourth electrical contacts would touch, the second and the fifth electrical contacts would touch, and the third and the sixth electrical contacts would touch. As a conventional light bulb with a standard Edison screw base cannot be screwed into double socket 1100, a light fixture using the double socket would qualify as a high energy efficient light fixture.

Figure 12:
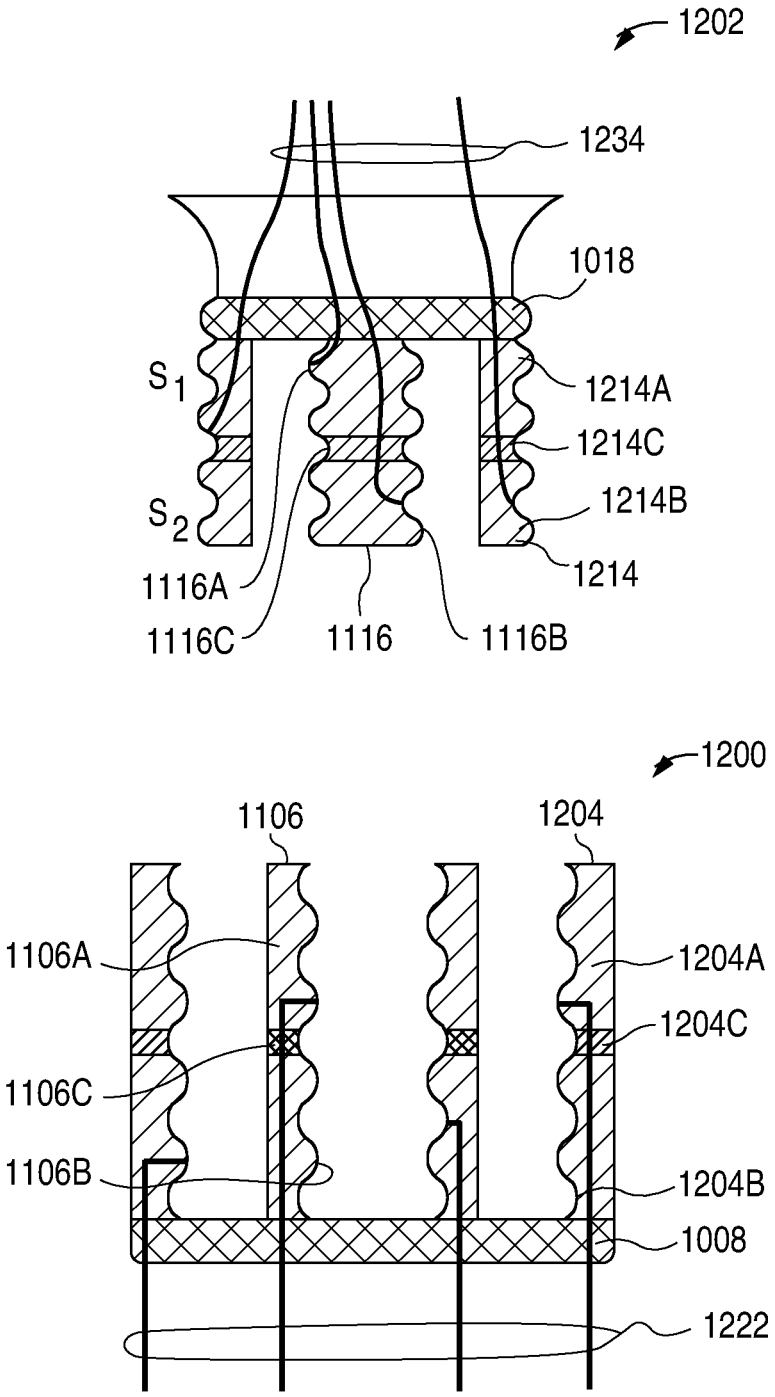
FIG. 12 shows a cross-sectional view of a lamp double socket and a compatible double screw base with their electrical contacts in a double inner-double outer configuration.

FIG. 12 shows a cross-sectional view of a lamp assembly with a lamp double socket 1200 and a compatible double screw base 1202 with their electrical contacts in a double inner-double outer configuration in one or more embodiments of the present disclosure. Double socket 1200 is similar to double socket 1100 (FIG. 11) except outer socket 1004 (FIG. 11) has been replaced by an outer socket 1204. Socket 1204 has similar dimensions as socket 1004. Socket 1204 includes internal threads with a conductive upper portion 1204A and a conductive lower portion 1204B insulated from each other by a non-conductive middle portion 1204C. Conductive internal thread portions 1204A, 1204B, 1106A, and 1106B serve as first, third, second, and fourth electrical contacts to double screw base 1202. The four electrical contacts are connected directly or coupled indirectly to electrical lines 1222 out of double socket 1200. The four electrical contacts allows double socket 1200 to be used with multi-way bulbs or with relays for multi-way switching. Depending on the application, less than all the contacts may be utilized.

Double screw base 1202 is similar to double screw base 1102 (FIG. 11) except outer screw base 1014 (FIG. 11) has been replaced by an outer screw base 1214. Screw base 1214 has similar dimensions as screw base 1014. Screw base 1214 includes an open end and external threads with a conductive upper portion 1214A and a conductive lower portion 1214B insulated from each other by a non-conductive middle portion 1214C. Conductive external thread portions 1214A, 1214B, 1116A, and 1116B serve as fifth, sixth, seventh, and eighth electrical contacts to double socket 1200. Lead wires 1234 from the light source are connected directly or coupled indirectly to the four electrical contacts. Lead wires 1234 are connected to the light source according to the purpose of the application, such as providing a multi-way bulb or multi-way switching. Depending on the application, less than all the contacts may be utilized.

A light bulb with double screw base 1202 is screwed into double socket 1200 in a normal fashion so the first and the fifth electrical contacts would touch, the third and the sixth electrical contacts would touch, the second and the seventh electrical contacts would touch, and the fourth and the eighth electrical contacts would touch. As a conventional light bulb with a standard Edison screw base cannot be screwed into double socket 1200, a light fixture using the double socket would qualify as a high energy efficient light fixture.

Figure 13:
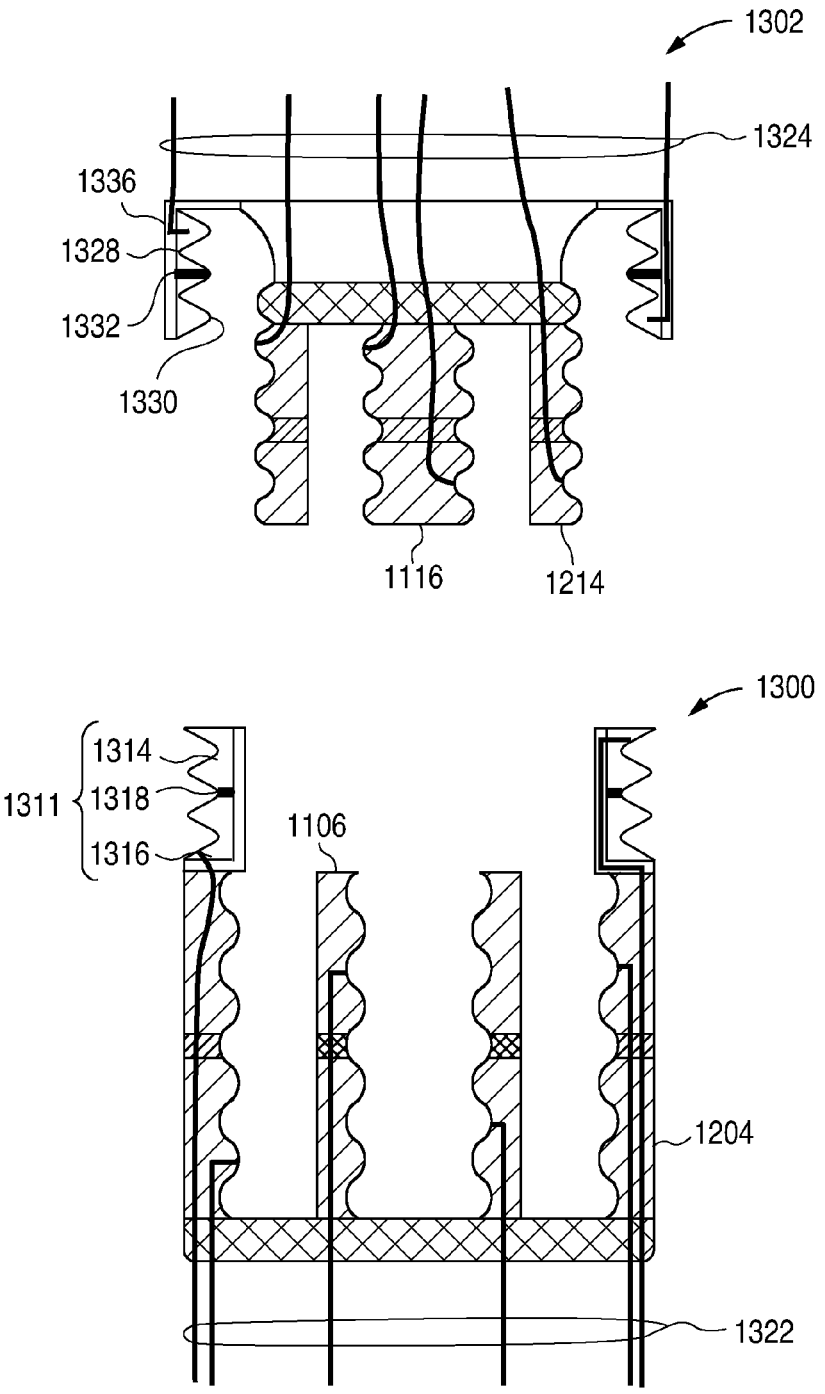
FIG. 13 shows a cross-sectional view of a lamp triple socket and a compatible triple screw base with their electrical contacts in a top-side configuration.

FIG. 13 shows a cross-sectional view of a lamp triple socket 1300 and a compatible triple screw base 1302 with their electrical contacts in a top-side configuration in one or more embodiments of the present disclosure. Triple socket 1300 is similar to double socket 1200 (FIG. 12) with top external threads 1311 added to outer socket 1204. External threads 1311 includes an upper conductive portion 1314 and a lower conductive portion 1316 insulated from each other by a non-conductive portion 1318. Conductive threaded portions 1204A (FIG. 12), 1204B (FIG. 12), 1106A (FIG. 12), 1106B (FIG. 12), 1314, and 1316, serve as first, third, second, fourth, ninth, and tenth electrical contacts to triple screw base 1302. The six electrical contacts are connected directly or coupled indirectly to electrical lines 1322 out of triple socket 1300. The six electrical contacts allows double socket 1100 to be used with multi-way bulbs or with relays for multi-way switching. Depending on the application, less than all the contacts may be utilized.

Triple screw base 1302 is similar to double screw base 1202 (FIG. 12) with an additional housing 1336. The lower open end of housing 1336 is internally threaded and includes a conductive upper portion 1328 and a conductive lower portion 1330 insulated from each other by a non-conductive middle portion 1332. Conductive threaded portions 1214A (FIG. 12), 1214B (FIG. 12), 1116A (FIG. 12), 1116B (FIG. 12), 1328, and 1330 serve as fifth, sixth, seventh, eighth, eleventh, and twelfth electrical contacts to triple socket 1300. Lead wires 1324 from the light source are connected directly or coupled indirectly to the six electrical contacts. Lead wires 1324 are connected to the light source according to the purpose of the application, such as providing a multi-way bulb or multi-way switching. Depending on the application, less than all the contacts may be utilized.

A light bulb with double screw base 1302 is screwed into double socket 1300 in a normal fashion so the first and the fifth electrical contacts would touch, the third and the sixth electrical contacts would touch, the second and the seventh electrical contacts would touch, the fourth and the eighth electrical contacts would touch, the ninth and the eleventh electrical contacts would touch, and the tenth and the twelfth electrical contacts would touch. As a conventional light bulb with a standard Edison screw base cannot be screwed into double socket 1300, a light fixture using the double socket would qualify as a high energy efficient light fixture.

Figure 14:
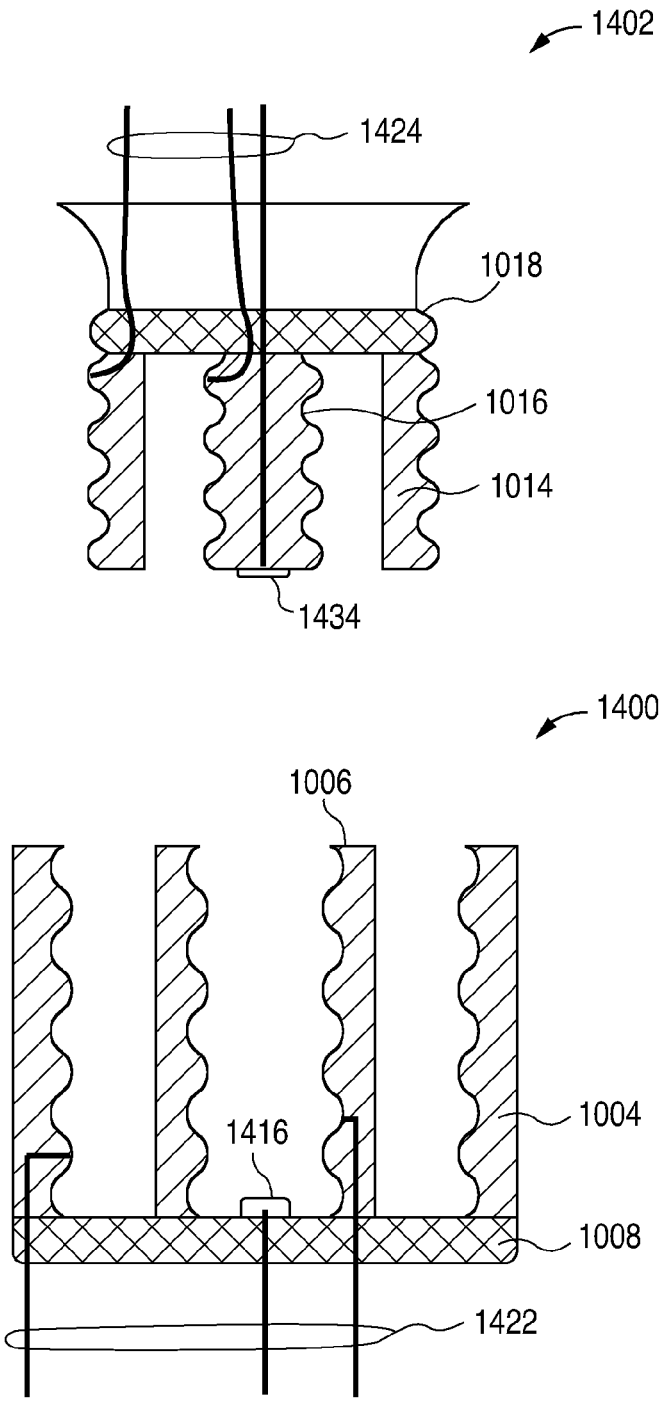
FIG. 14 shows a cross-sectional view of a lamp double socket and a compatible double screw base with their electrical contacts in a side-side-bottom configuration.

FIG. 14 shows a cross-sectional view of a lamp double socket 1400 and a compatible double screw base 1402 with their electrical contacts in a side-side-bottom configuration in one or more embodiments of the present disclosure. Double socket 1400 is similar to double socket 1000 (FIG. 10) with an additional bottom contact 1416 added within inner socket 1006 on socket base 1008. Conductive internal threads of sockets 1004, 1006 and bottom contact 1416 serve as first, second, and third electrical contacts to double screw base 1402. The three electrical contacts are connected directly or coupled indirectly to electrical lines 1422 out of double socket 1400. The three electrical contacts allows double socket 1400 to be used with three-way bulbs or with relays for three-way switching. Depending on the application, less than all the contacts may be utilized.

Double screw base 1402 is similar to double screw base 1002 (FIG. 10) with an additional bottom contact 1434 added to the bottom of inner screw base 1016. Conductive external threads of screw bases 1014, 1016, and bottom contact 1434 serve as fourth, fifth, and sixth electrical contacts to double socket 1400. Lead wires 1424 from the light source are connected directly or coupled indirectly to the three electrical contacts. Lead wires 1424 are connected to the light source according to the purpose of the application, such as providing a multi-way bulb or multi-way switching. Depending on the application, less than all the contacts may be utilized.

A light bulb with double screw base 1402 is screwed into double socket 1400 in a normal fashion so the first and the fourth electrical contacts would touch, the second and the fifth electrical contacts would touch, and the third and the sixth electrical contacts would touch. As a conventional light bulb with a standard Edison screw base cannot be screwed into double socket 1400, a light fixture using the double socket would qualify as a high energy efficient light fixture.

Figure 15:
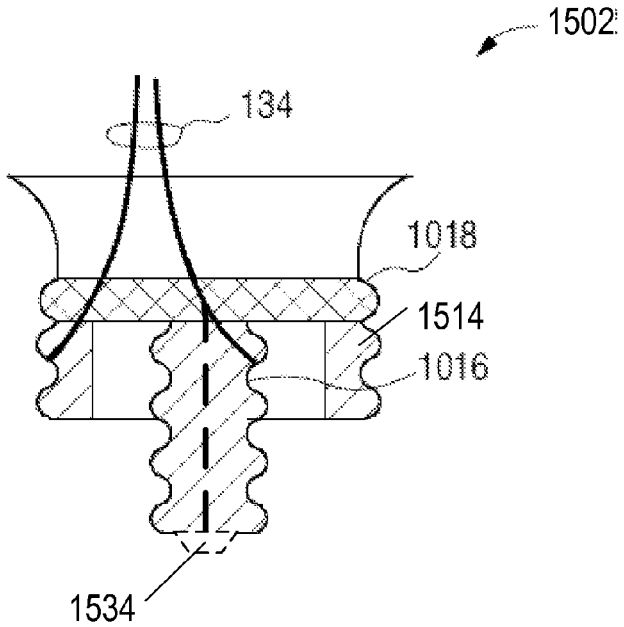
FIG. 15 shows a cross-sectional view of a lamp socket and a compatible screw base with their electrical contacts in a second side-bottom configuration.
Figure 15:
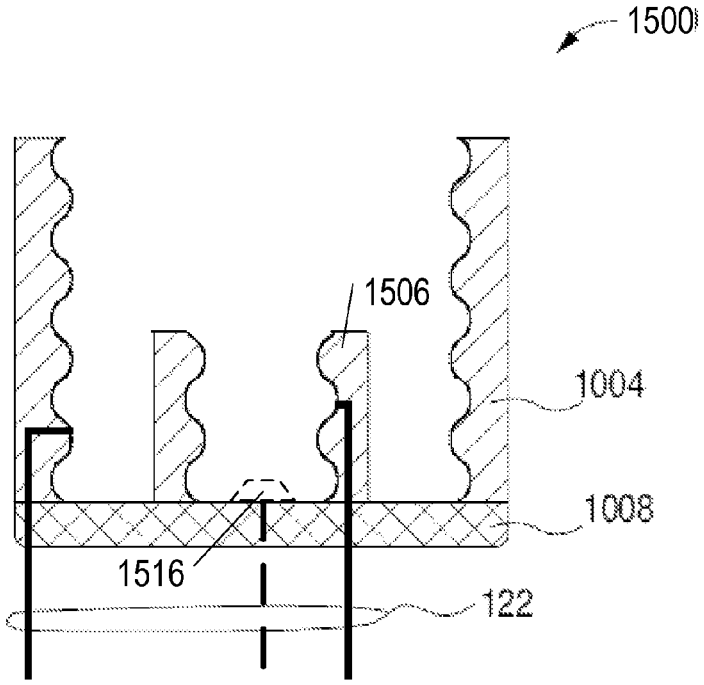

FIG. 15 shows a cross-sectional view of a lamp assembly having a lamp double socket 1500 and a compatible double screw base 1502 with their electrical contacts in an inner-outer configuration in one or more embodiments of the present disclosure. Double socket 1500 includes two socket portions of different diameters so a light bulb with a standard Edison screw base cannot be installed in double socket 1500.

Double socket 1500 is similar to double socket 1000 (FIG. 10) with a shorter inner socket 1506 instead of the taller inner socket 1006 (FIG. 10) Inner socket 1506 is of similar construction as inner socket 1006. Outer socket 1004 and inner socket 1506 are concentrically seated on socket base 1008. Sockets 1004 and 1506 are generally cylindrical and include conductive internal threads that serve as first and second electrical contacts to double screw base 1502. Alternatively sockets 1004 and 1506 have nonconductive internal threads and conductive tabs on the internal threads that serve as the first and the second electrical contacts. Alternatively a second electrical contact 1516 (shown in phantom) is located on socket base 1008 within inner socket 1506.

Double screw base 1502 is similar to double screw base 1002 (FIG. 10) with a shorter outer screw base 1514 instead of the taller outer screw base 1014 (FIG. 10). Outer screw base 1514 is of similar construction as outer screw base 1014.

Outer screw base 1514 and inner screw base 1016 are concentrically seated on a base 1018. Screw bases 1514 and 1016 are generally cylindrical and have conductive external threads that match the internal threads of sockets 1004, 1506 and serve as third and fourth electrical contacts to double socket 1500. Alternatively screw bases 1514 and 1016 have nonconductive external threads and conductive tabs on the external threads that serve as the third and the fourth electrical contacts. Alternatively a fourth electrical contact 1534 (shown in phantom) is located on the tip of inner screw base 1016.

A light bulb with double screw base 1502 is screwed into double socket 1500 in a normal fashion so the first and the third electrical contacts would touch, and the second and the fourth electrical contacts would touch. As a conventional light bulb with a standard Edison screw base cannot be screwed into double socket 1500, a light fixture using the double socket would qualify as a high energy efficient light fixture. Furthermore, a light bulb with double screw base 1502 is still compatible with a conventional Edison lamp socket.

Figure 16A:
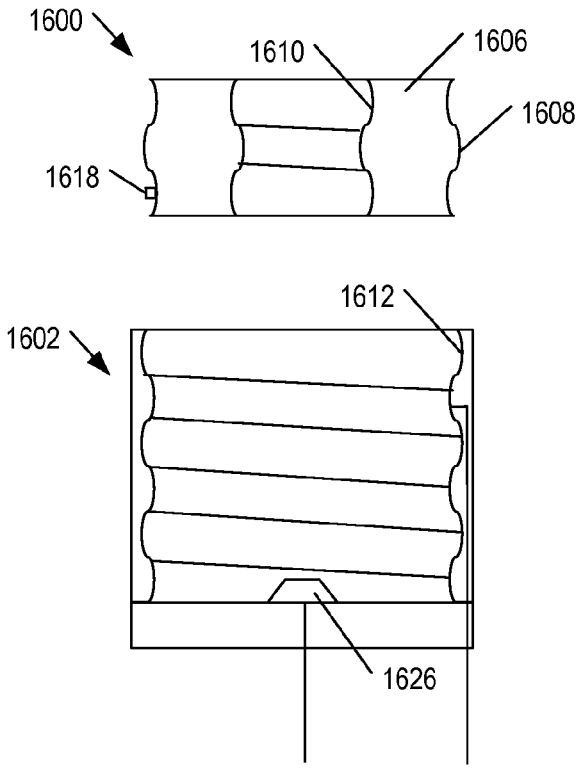
FIGS. 16A, 16B, and 16C show cross-sectional view of an adapter ring for modifying a standard lamp socket to a double socket.
Figure 16B:
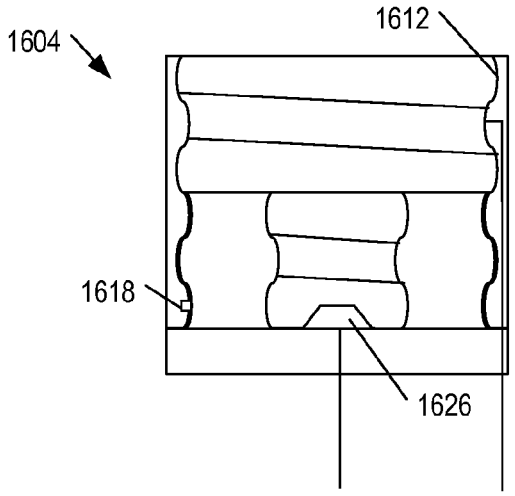
Figure 16C:
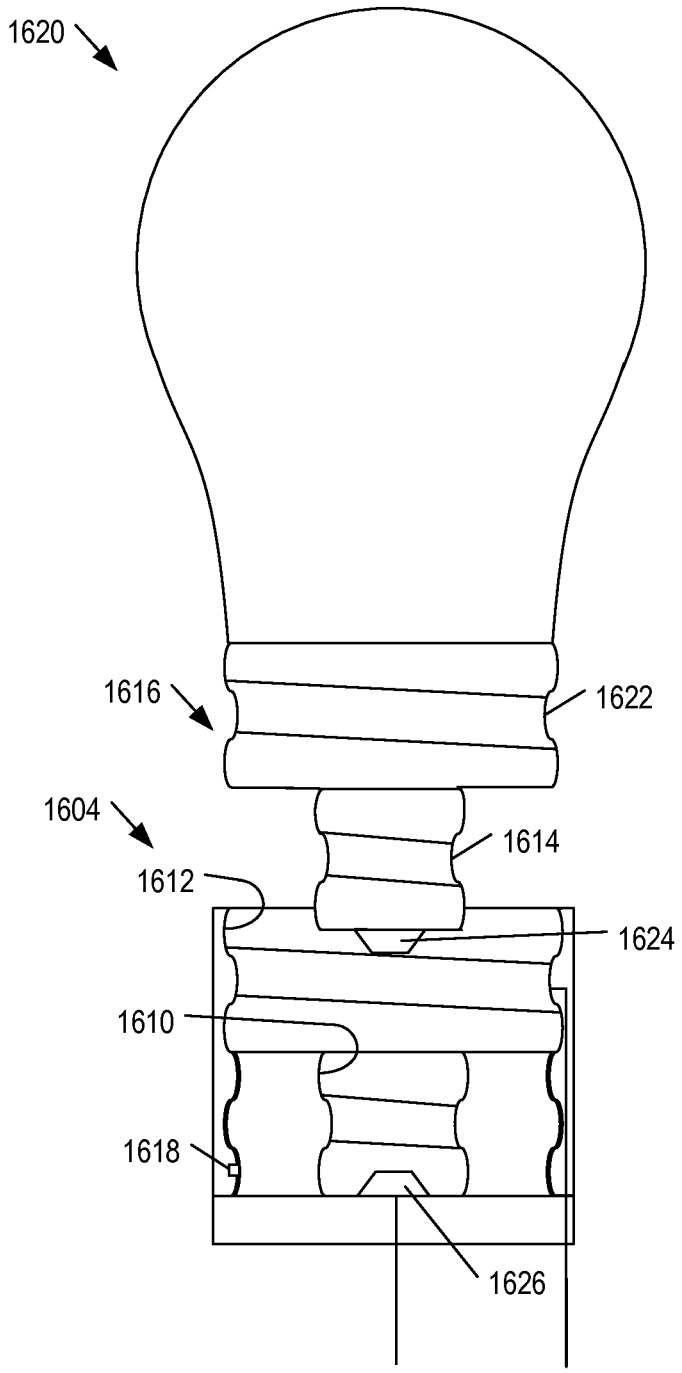

FIG. 16A shows an adapter ring 1600 to change a standard Edison lamp socket 1602 to a lamp double socket 1604 shown in FIG. 16B in examples of the present disclosure. Lamp socket 1604 is similar to lamp socket 900 (FIG. 9). Referring to FIG. 16A, adapter ring 1600 has outer threads 1608 and defines a threaded hole 1610. Outer threads 1608 of adapter ring 1600 match the inner threads 1612 of Edison lamp socket 1602. Referring to FIG. 16C, threaded hole 1610 of adapter ring 1600 match the outer threads of a narrow, lower portion 1614 of a screw base 1616, which is similar to screw base 908 (FIG. 9).

Referring back to FIG. 16A, a tamper proof element 1618 may be provided on outer threads 1608 to prevent the removal of adapter ring 1600 once it has been installed in Edison lamp socket 1602. For example, tamper proof element 1618 may be a spring barb that projects into inner threads 1612 of Edison lamp socket 1602. When screwed into Edison lamp socket 1602, threaded hole 1610 of adapter ring 1600 exposes a bottom electrical contact 1626 of lamp socket 1604.

FIG. 16C shows a light bulb 1620 with double screw base 1616 being screwed into lamp socket 1604 in examples of the present disclosure. Double screw base 1616 includes a wide upper portion 1622 of a first diameter and a narrow lower portion 1614 of a second diameter. Wide upper portion 1623 has the diameter and threads of a standard Edison screw base. Narrow lower portion 1614 has the threads that match threaded hole 1610 of adapter ring 1600. Once installed in lamp socket 1604, an electrical foot contact 1624 on the tip of narrow lower portion 1614 of light bulb 1620 touches bottom electrical contact 1626 of lamp socket 1604.

Figure 17A:
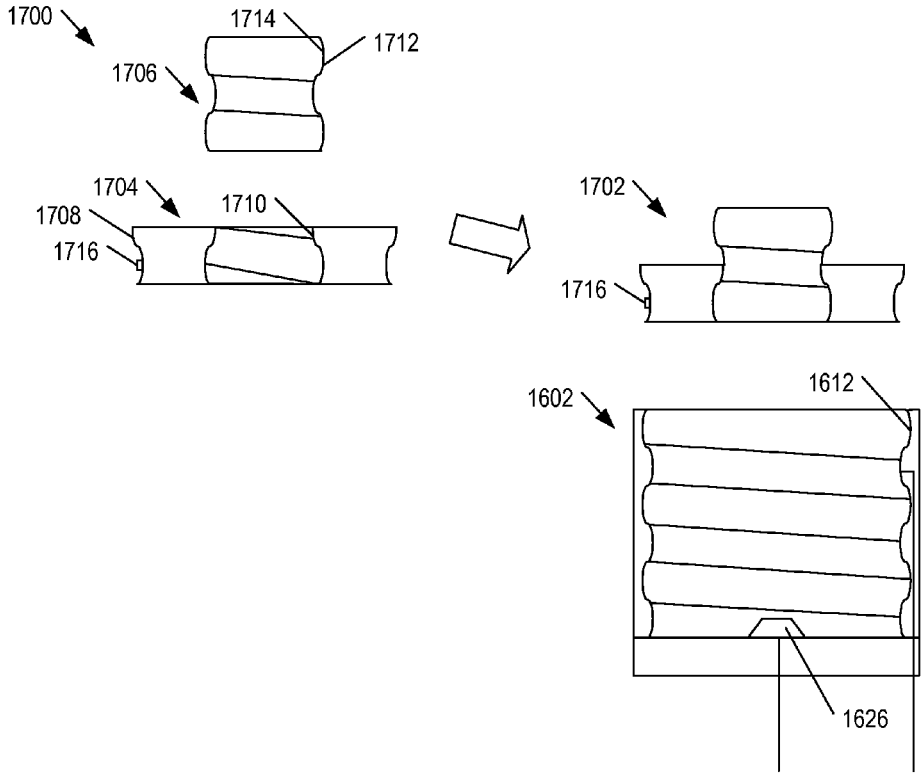
FIGS. 17A and 17B show cross-sectional view of an adapter ring for modifying a standard lamp socket to a double socket.
Figure 17B:
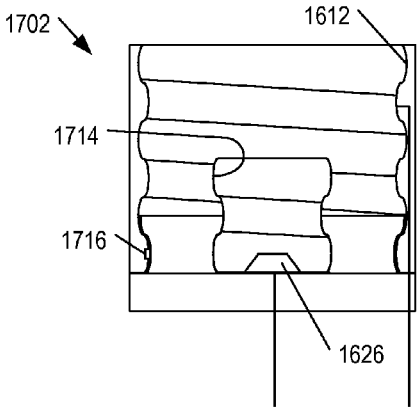

FIG. 17A shows an adapter 1700 to change a standard Edison lamp socket 1602 to a double socket 1702 shown in FIG. 17B in examples of the present disclosure. Double socket 1702 is similar to double socket 1500 (FIG. 15). Referring to FIG. 17A, adapter 1700 includes a nonconductive ring 1704 and a conductive or nonconductive cylindrical sleeve 1706. Ring 1704 has outer threads 1708 and a threaded hole 1710. Outer threads 1708 of ring 1704 match the inner threads 1612 of Edison lamp socket 1602. Sleeve 1706 has outer threads 1712 and inner threads 1714. Outer threads 1712 of sleeve 1706 match the threads of threaded hole 1710 of ring 1704. Inner threads 1714 of sleeve 1706 match the outer threads of an inner screw base 1016 (FIG. 15) of a double screw base 1502 (FIG. 15).

A tamper proof element 1716, such as a spring barb, may be provided on outer threads 1708 of ring 1704 to prevent the removal of adapter 1700 once it has been installed in Edison lamp socket 1602. Referring to FIG. 17B, sleeve 1706 may be conductive and have a top end that is open and a bottom end that is closed or has an extended portion to contact a bottom electrical contact 1626 of Edison lamp socket 1602. This allows sleeve 1706 to become an electrical contact to screw base 1502 (FIG. 15). Alternatively sleeve 1706 may be nonconductive and have an open end to expose bottom electrical contact 1626 of Edison lamp socket 1602. This allows bottom electrical contact 1626 of Edison lamp socket 1602 to touch an electrical foot contact 1534 (FIG. 15) of screw base 1502.

Instead of being constructed of threaded parts, adapter 1700 is an integral piece of nonconductive material such as plastic.

Figure 18A:
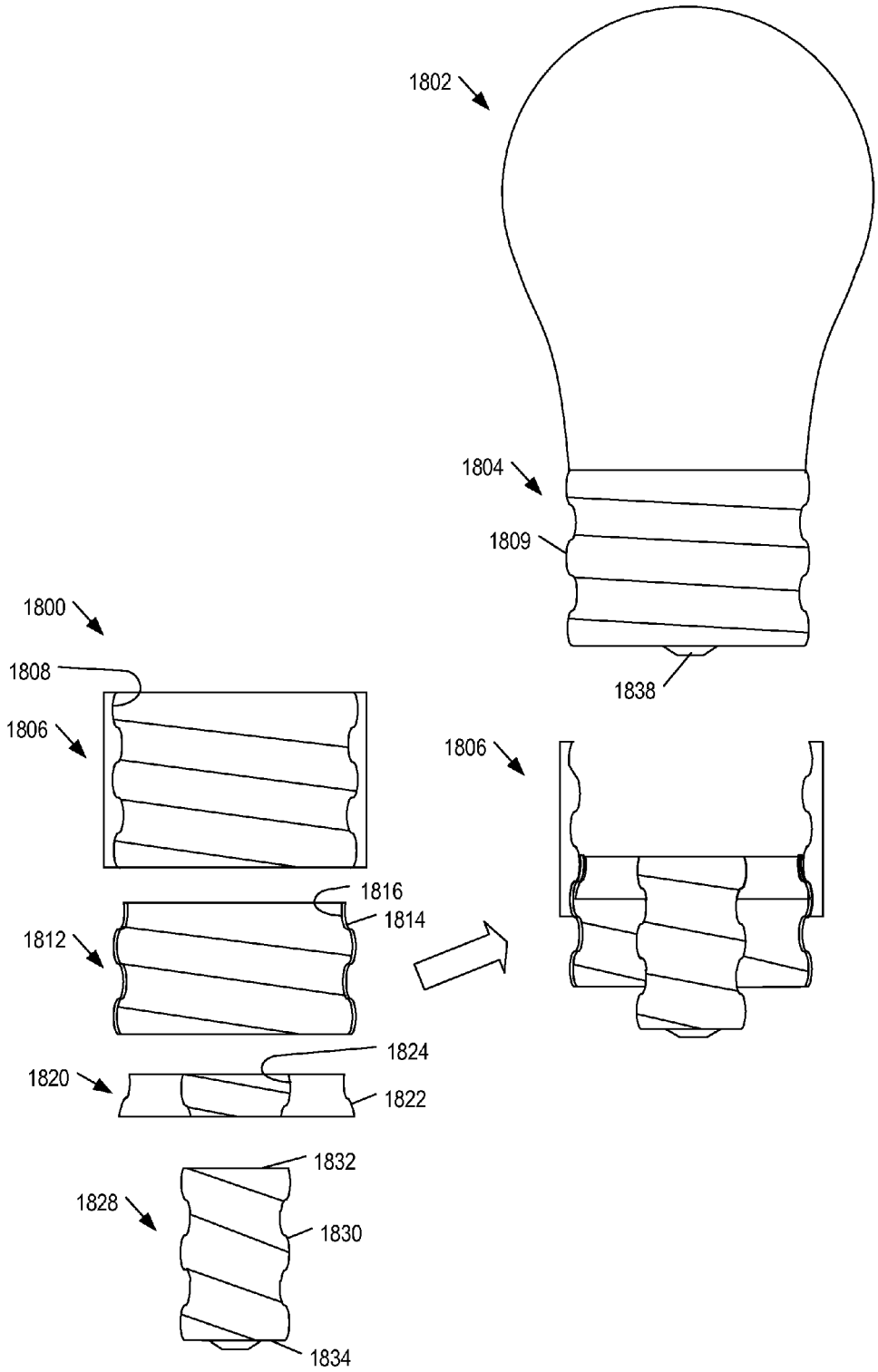
FIGS. 18A and 18B show cross-sectional view of an adapter for modifying a standard screw base to a double screw base.
Figure 18B:
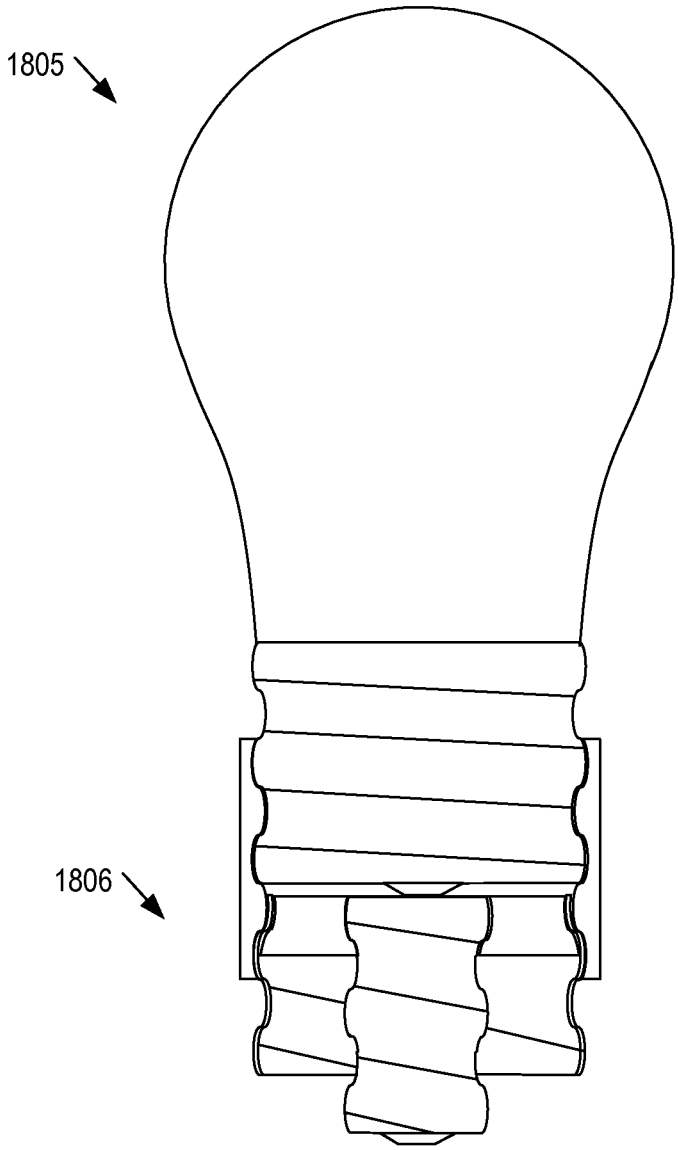

FIG. 18A shows an adapter 1800 to change a light bulb 1802 with a standard Edison screw base 1804 to a light bulb 1805 with a double screw base 1806 as shown in FIG. 18B in examples of the present disclosure. Double screw base 1806 is similar to double screw base 1502 (FIG. 15).

Referring to FIG. 18A, adapter 1800 includes a conductive, socket-size sleeve 1806 with inner threads 1808 that match threads 1809 of a screw thread contact on standard Edison screw base 1804. A tamper proof element, such as a spring barb, may be provided on inner threads 1808 to prevent the removal of socket-size sleeve 1806 once it has been installed in standard Edison screw base 1804.

Adapter 1800 includes a conductive base-size sleeve 1812 with outer threads 1814 and inner threads 1816. Outer threads 1814 of base-size sleeve 1812 have the same dimension as a standard Edison screw base to match inner threads 1808 of socket-size sleeve 1806. Base-size sleeve 1812 is screwed into socket-size sleeve 1806 to forms a screw thread contact for the resulting light bulb. A tamper proof element, such as a spring barb, may be provided on outer threads 1814 to prevent the removal of base-size sleeve 1812 once it has been installed in socket-size sleeve 1806.

Adapter 1800 includes an insulator ring 1820 with outer threads 1822 and a threaded hole 1824. Outer threads 1822 of insulator ring 1820 match inner threads 1816 of base-size sleeve 1812. Insulator ring 1820 is screwed into base-size sleeve 1812. A tamper proof element, such as a spring barb, may be provided on outer threads 1822 to prevent the removal of insulator ring 1820 once it has been installed in base-size sleeve 1812.

Adapter 1800 includes a conductive candelabra-size screw base 1828 with outer threads 1830 and closed ends 1832, 1834. Outer threads 1830 matches the threads in threaded hole 1824 of cylindrical insulator 1820 and the inner threads of inner socket 1506 (FIG. 15) of a lamp double socket 1500 (FIG. 15). Candelabra-size screw base 1828 is screwed into cylindrical insulator 1820 so top end 1832 of candelabra-size screw base 1828 touches a bottom electrical contact 1838 of standard Edison screw base 1804 and candelabra-size screw base 1828 forms an electrical foot contact for the resulting light bulb. A tamper proof element, such as a spring barb, may be provided on outer threads 1830 to prevent the removal of candelabra-size screw base 1828 once it has been installed in cylindrical insulator 1820.

Figure 19A:
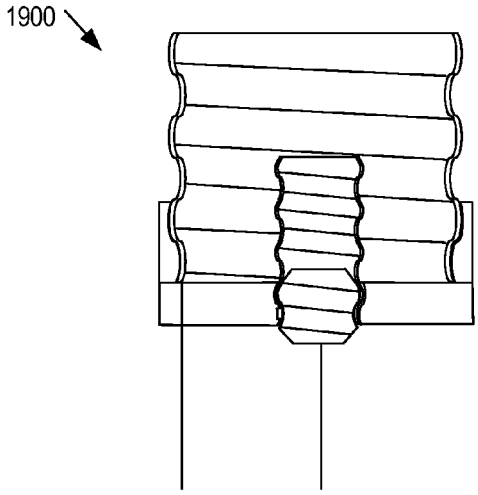
FIGS. 19A and 19B show cross-sectional views of a double socket constructed with threaded parts.

FIG. 19A shows a lamp double socket 1900 constructed with threaded parts in examples of the present disclosure. The threaded parts may be assembled and fixed relative to each other by a bonding agent or by locking elements, such as spring barbs. Double socket 1900 is similar to double socket 1500 (FIG. 15).

Figure 19B:
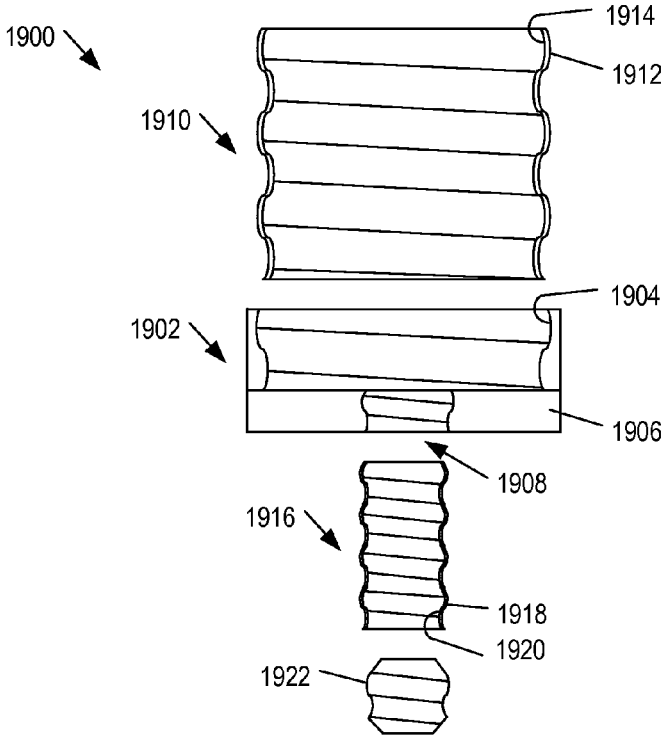

Referring to FIG. 19B, double socket 1900 includes a cup-shape bottom base 1902 with inner threads 1904 and a bottom 1906. Either or both inner threads 1904 and bottom 1906 are nonconductive. Bottom 1906 defines a threaded hole 1908.

Double socket 1900 includes a conductive outer sleeve 1910 with outer threads 1912 and inner threads 1914. Outer sleeve 1910 is screwed into bottom base 1902 to form an outer socket similar to outer socket 1004 (FIG. 15) of double socket 1500. Inner threads 1914 of outer sleeve 1910 may have the dimensions of threads in a standard Edison lamp socket.

Double socket 1900 includes a conductive inner sleeve 1916 with outer threads 1918 and inner threads 1920. Double socket 1900 includes a conductive, externally threaded center plug 1922. Center plug 1922 is screwed into the lower end of inner sleeve 1916, and inner sleeve 1916 is screwed into hole 1908 of bottom base 1902 to form an inner socket similar to inner socket 1506 (FIG. 15) of lamp double socket 1500.

Figure 20A:
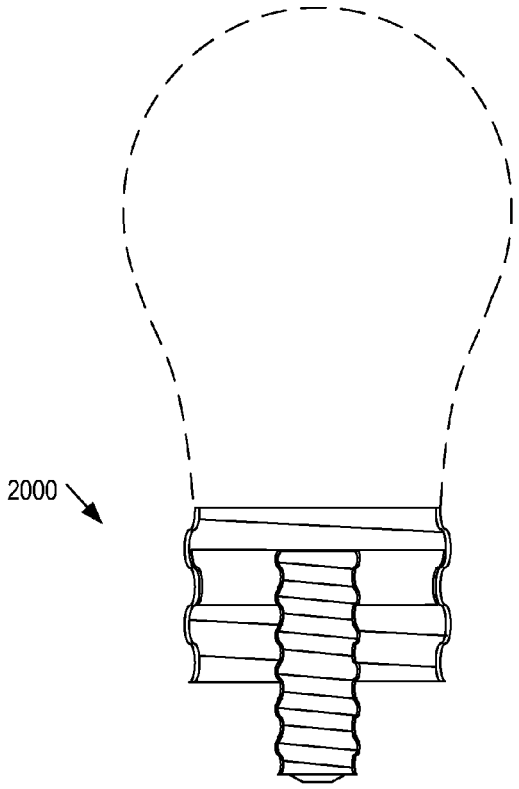
FIGS. 20A and 20B show cross-sectional views of a double screw base constructed with threaded parts.

FIG. 20A shows a double screw base 2000 constructed with threaded parts in examples of the present disclosure. The threaded parts may be assembled and fixed relative to each other by a bonding agent or by a locking element, such as a spring barb. Double screw base 2000 is similar to double screw base 1502 (FIG. 15).

Figure 20B:
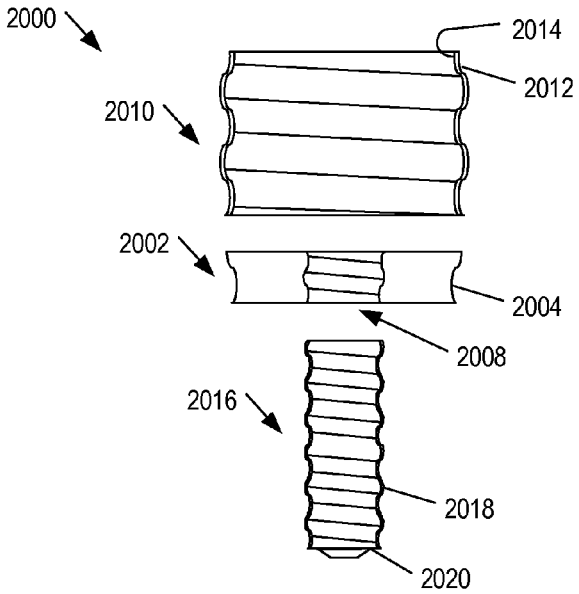

Referring to FIG. 20B, double screw base 2000 includes a nonconductive top base 2002 having outer threads 2004 and defining a threaded hole 2008.

Double screw base 2000 includes a conductive outer sleeve 2010 with outer threads 2012 and inner threads 2014. Outer threads 2012 may have the dimension of the threads on a standard Edison screw base to form an electrical contact. Inner threads 2014 matches the outer threads 2004 of top base 2002. Top base 2002 is screwed into outer sleeve 2010.

Double screw base 2000 includes a conductive inner sleeve 2016 with outer threads 2018. Inner sleeve 2016 may have a closed end 2020. Inner sleeve 2016 is screwed into hole 2008 of bottom base 1902 to form another electrical contact.

Figure 21A:
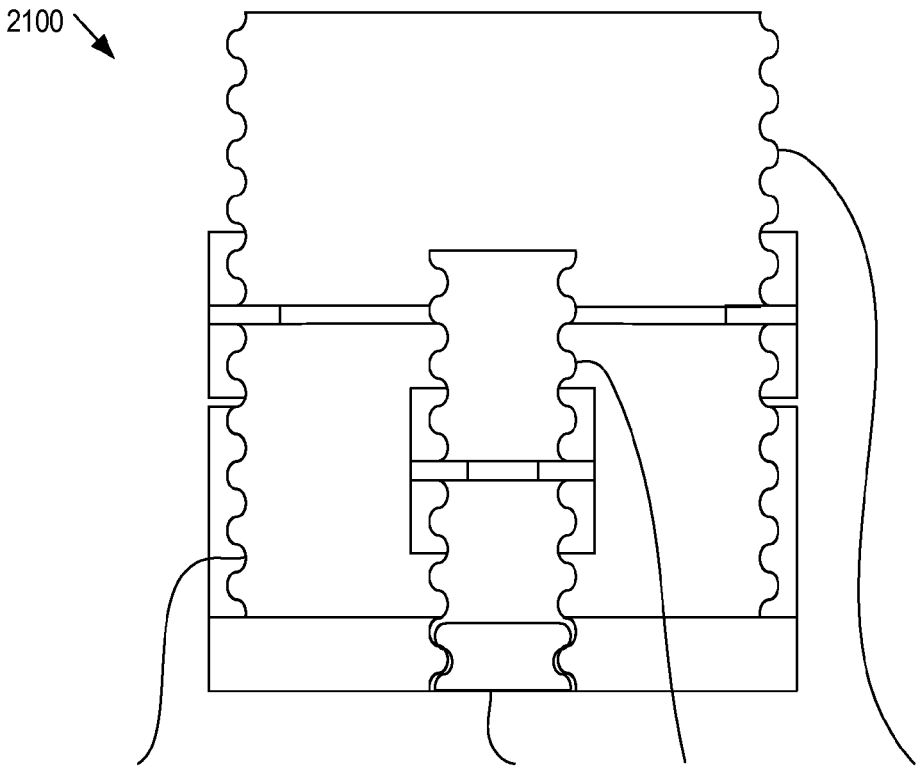
FIGS. 21A and 21B show cross-sectional views of a double socket with additional electrical contacts.

FIG. 21A shows a lamp double socket 2100 constructed with threaded parts in examples of the present disclosure. The threaded parts may be assembled and fixed relative to each other by a bonding agent or by a locking element, such as a spring barb. Double socket 2100 is similar to double socket 1900 (FIG. 19) except the inner and the outer sockets have been extended to provide additional electrical contacts. For clarity, threads are not illustrated in FIGS. 21A and 21B.

Figure 21B:
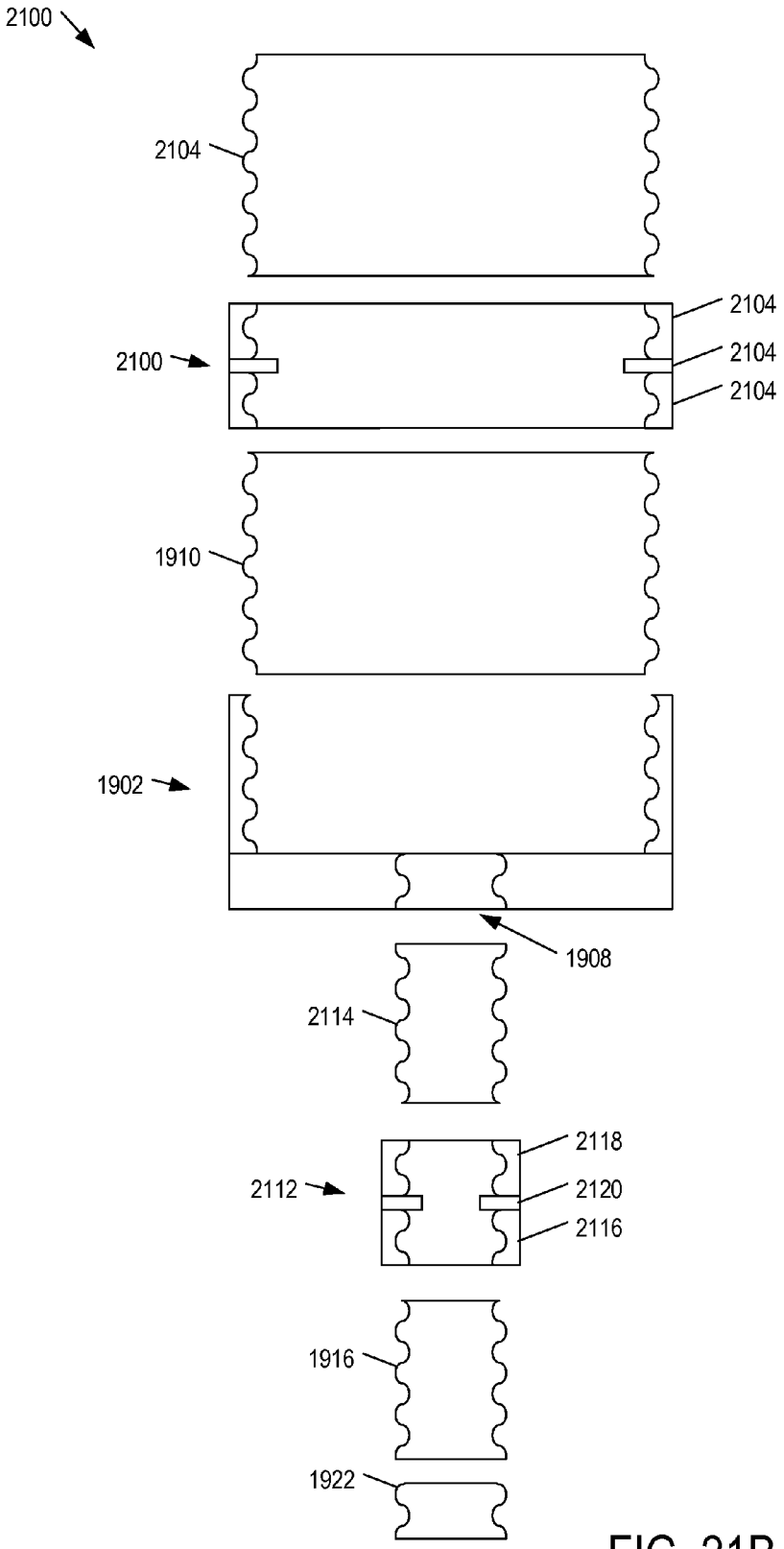

Referring to FIG. 21B, outer sleeve 1910 is screwed into bottom base 1902. A nonconductive, internally threaded T-shape sleeve 2102 is screwed onto the outer threads of outer sleeve 1910. Another outer sleeve 2104, which is similarly constructed as outer sleeve 1910, is screwed into T-shape sleeve 2102. T-shape sleeve 2102 has a lower portion 2106 and an upper portion 2108, and a ring 2110 between portions 2106 and 2108 to prevent outer sleeves 1910 and 2104 from touching. Thus T-shape sleeve 2102 joins outer sleeves 1910 and 2104 to form an outer socket similar to outer socket 1204 (FIG. 12) of double socket 1200 (FIG. 12).

Center plug 1922 is screwed into the lower end of inner sleeve 1916. A nonconductive, internally threaded T-shape sleeve 2112 is screwed onto the outer threads of inner sleeve 1916. Another inner sleeve 2114, which is similarly constructed as inner sleeve 1916, is screwed into T-shape sleeve 2112. T-shape sleeve 2112 has a lower portion 2116 and an upper portion 2118 separated by a ring 2120 that prevents inner sleeves 1916 and 2114 from touching. Thus T-shape sleeve 2112 joins inner sleeves 1916 and 2114 to form an inner socket similar to inner socket 1106 (FIG. 12) of double socket 1200 (FIG. 12).

Referring back to FIG. 21A, wires are connected to sleeves 1910, 2104, 1916, and 2114 to form electrical contacts to a light bulb with a double screw base. Note that the heights of outer sleeve 1910 and inner sleeve 1916 may be adjusted so T-shape sleeves 2102 and 2112 may respectively demarcate outer sleeves 1910, 2104 and inner sleeves 1916, 2114 at different heights as shown in FIG. 21A or at the same height.

Figure 22A:
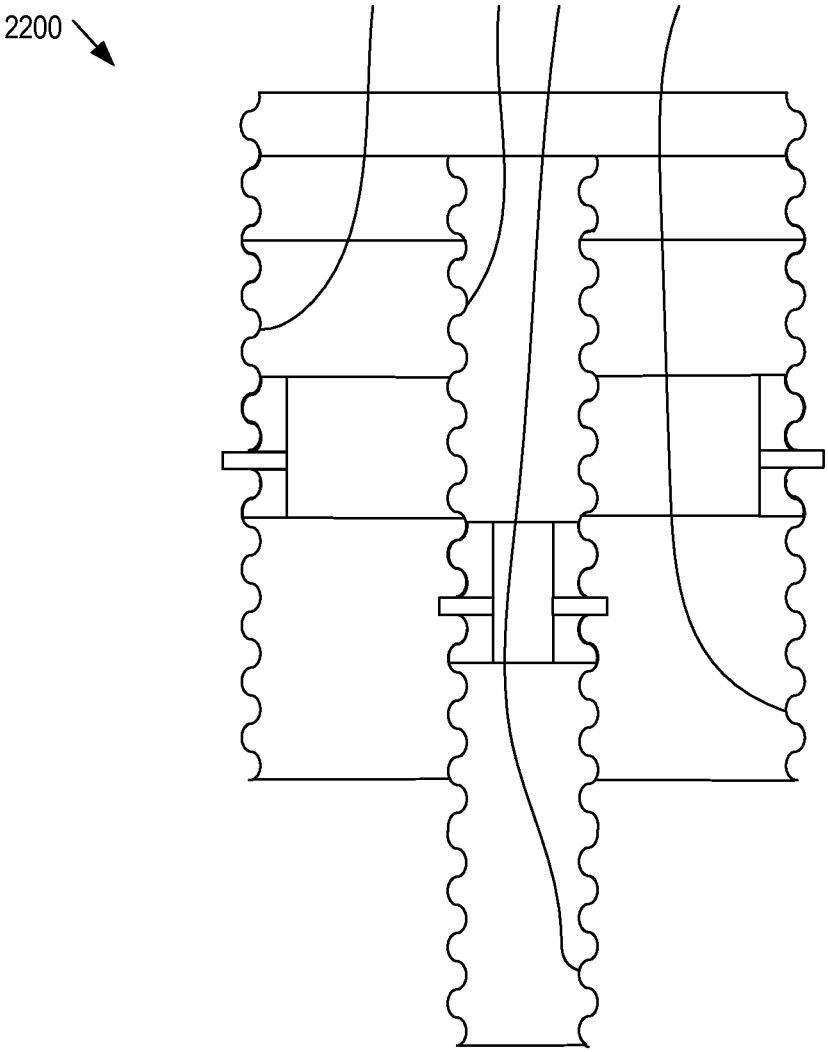
FIGS. 22A and 22B show cross-sectional views of a double screw base with additional electrical contacts.

FIG. 22A shows a double screw base 2200 constructed with threaded parts in examples of the present disclosure. The threaded parts may be assembled and fixed relative to each other by a bonding agent or by a locking element, such as a spring barb. Double screw base 2200 is similar to double screw base 2000 (FIG. 20) except the inner and the outer screw bases have been extended with additional electrical contacts. For clarity, threads are not illustrated in FIGS. 22A and 22B.

Figure 22B:
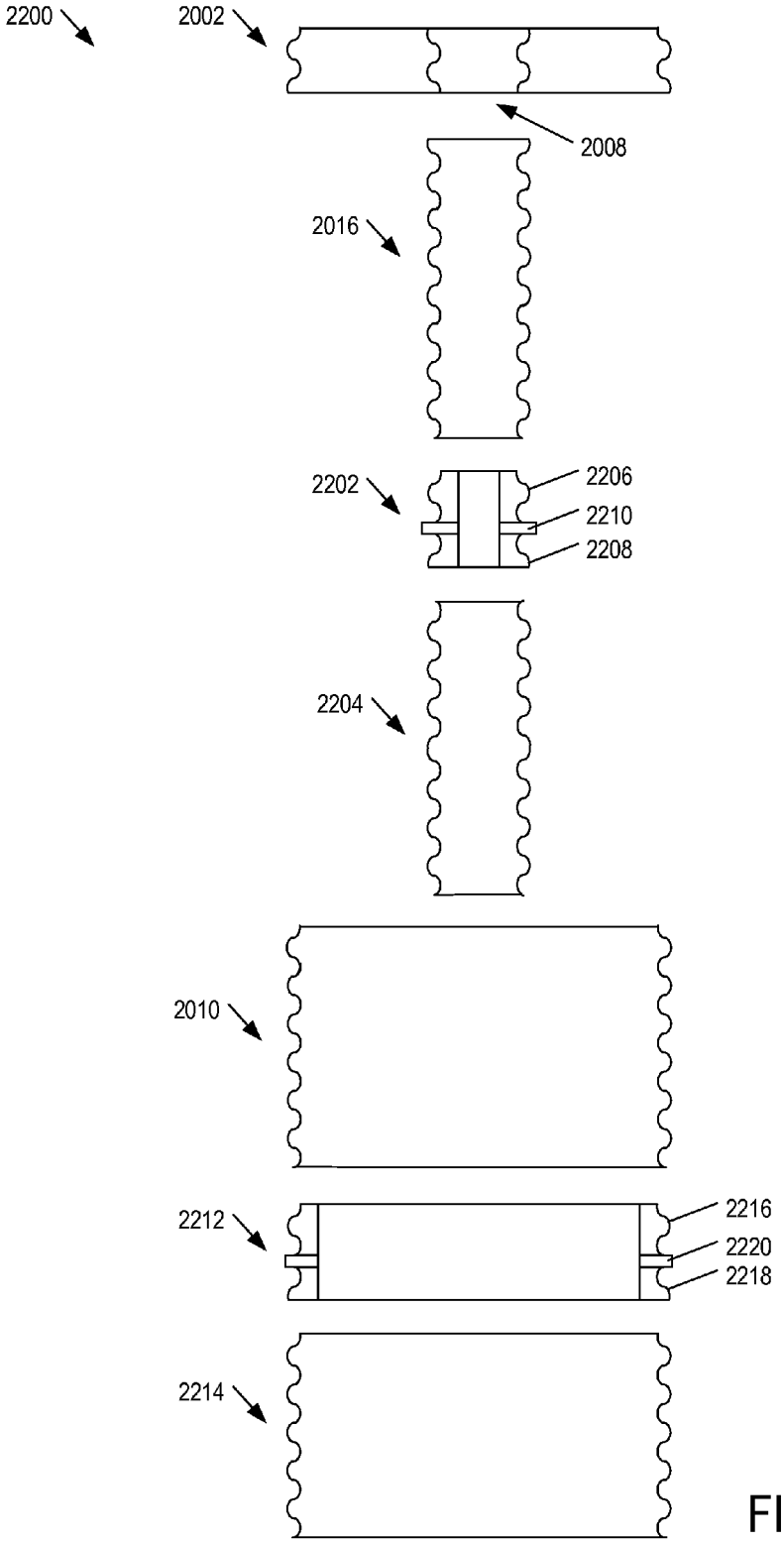

Referring to FIG. 22B, inner sleeve 2016 with open ends is screwed into hole 2008 of top base 2002, and top base 2002 is screwed onto outer sleeve 2010. A nonconductive, externally threaded T-shape sleeve 2202 is screwed into inner sleeve 2016. Another inner sleeve 2204, which is similarly constructed as inner sleeve 2016, is screwed onto T-shape sleeve 2202. Inner sleeve 2204 may have a closed end 2205. T-shape sleeve 2202 has an upper portion 2206 and a lower portion 2208 separated by a ring 2210 that prevents inner sleeves 2016 and 2204 from touching. Thus T-shape sleeve 2202 joins inner sleeves 2016 and 2204 to form an inner screw base similar to inner screw base 1116 (FIG. 12) of double screw base 1202 (FIG. 12).

A nonconductive, externally threaded T-shape sleeve 2212 is screwed into outer sleeve 2010. Another outer sleeve 2214, which is similarly constructed as outer sleeve 2010, is screwed onto T-shape sleeve 2212. T-shape sleeve 2212 has an upper portion 2216 and a lower portion 2218 separated by a ring 2220 that prevents outer sleeves 2010 and 2214 from touching. Thus T-shape sleeve 2212 joins outer sleeves 2010 and 2214 to form an outer screw base similar to outer screw base 1214 (FIG. 12) of double screw base 1202 (FIG. 12).

Referring back to FIG. 22A, wires are connected to sleeves 2010, 2214, 2016, and 2204 to form electrical contacts to a double socket. Note that the heights of outer sleeve 2010 and inner sleeve 2016 may be adjusted so T-shape sleeves 2202 and 2212 may respectively demarcate outer sleeves 2010, 2214 and inner sleeves 2016, 2204 at different heights as shown in FIG. 22A or at the same height.

Figure 23A:
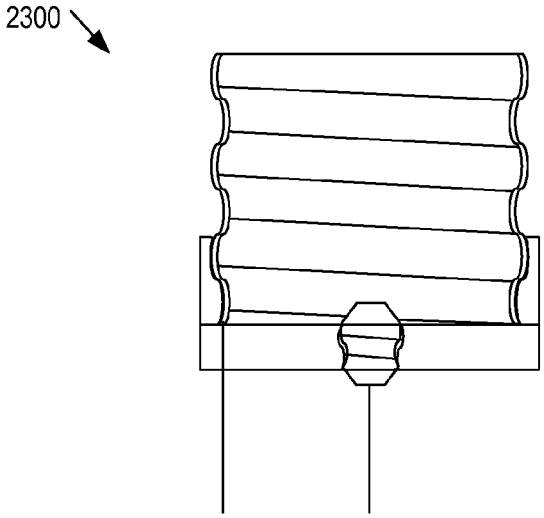
FIGS. 23A and 23B show cross-sectional views of an Edison lamp socket constructed with threaded parts.

FIG. 23A shows an Edison lamp socket 2300 constructed with threaded parts in examples of the present disclosure. The threaded parts may be assembled and fixed relative to each other by a bonding agent or by a locking element, such as a spring barb. The threaded parts may be shared with those used to construct lamp double sockets, such as lamp double sockets 1900 (FIG. 19) and 2100 (FIG. 21).

Figure 23B:
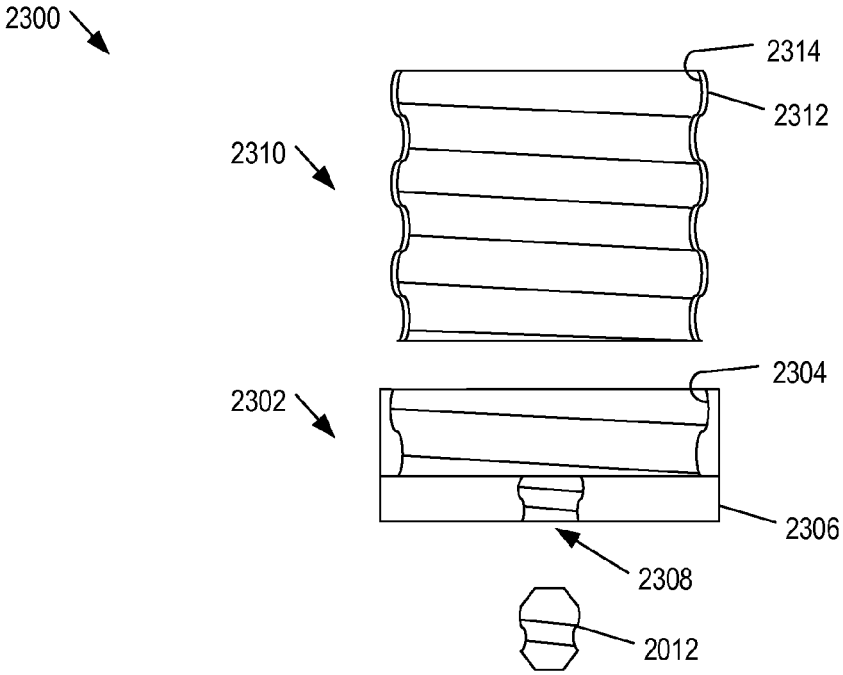

Referring to FIG. 23B, socket 2300 includes a cup-shape bottom base 2302 with an internally threaded sidewall 2304 and a bottom 2306. Either or both sidewall 2304 and bottom 2306 are nonconductive. Bottom 2306 defines a threaded hole 2308.

Socket 2300 includes a conductive sleeve 2310 with outer threads 2312 and inner threads 2314. Outer sleeve 2310 is screwed into bottom base 2302. Inner threads 2314 of sleeve 2310 may have the dimension of threads in a standard Edison lamp socket.

Socket 2300 includes a conductive, externally threaded center plug 2322. Center plug 2322 is screwed into hole 2308 of bottom base 2302.

Figure 24A:
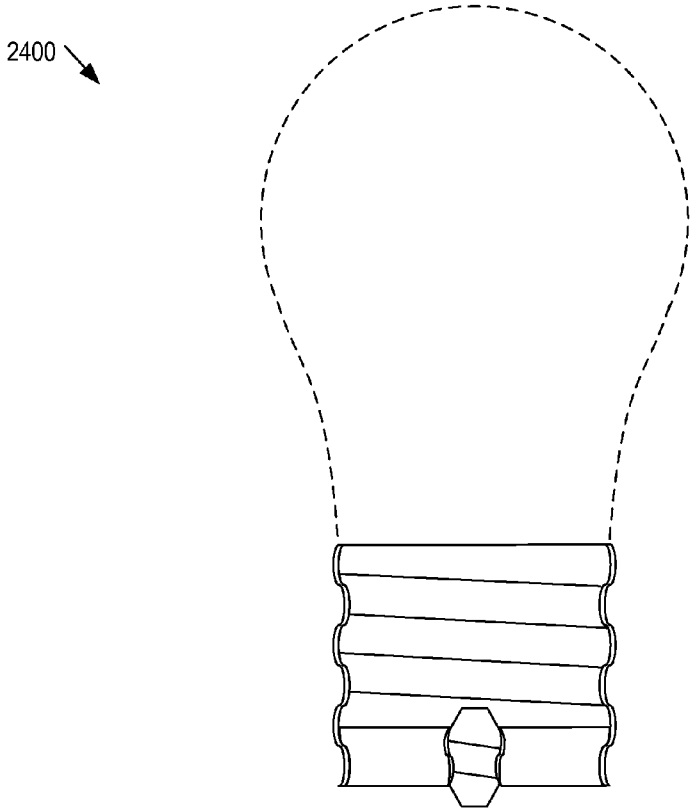
FIGS. 24A and 24B show cross-sectional views of an Edison screw base constructed with threaded parts, all arranged in accordance with at least some embodiments of the present disclosure Use of the same reference numbers in different figures indicates similar or identical elements.

FIG. 24A shows an Edison screw base 2400 constructed with threaded parts in examples of the present disclosure. The threaded parts may be assembled and fixed relative to each other by a bonding agent or by a locking element, such as a spring barb. The threaded parts may be shared with those used to construct double screw bases, such as double screw bases 2000 (FIG. 20) and 2200 (FIG. 22).

Figure 24B:
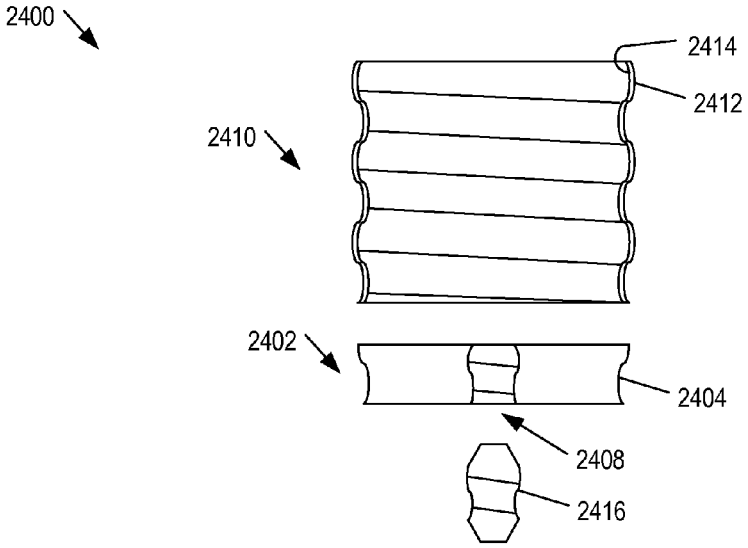

Referring to FIG. 24B, screw base 2400 includes a nonconductive base 2402 having outer threads 2404 and defining a threaded hole 2408.

Screw base 2400 includes a conductive sleeve 2410 with outer threads 2412 and inner threads 2414. Outer threads 2412 may have the dimension of the threads on a standard Edison screw base to form an electrical contact. Inner threads 2414 match the outer threads 2404 of base 2402. Base 2402 is screwed into sleeve 2410.

Screw base 2400 includes a conductive, externally threaded center plug 2416. Center plug 2416 is screwed into hole 2408 of bottom base 2402.

Various other adaptations and combinations of features of the embodiments disclosed are within the scope of the invention. Numerous embodiments are encompassed by the following claims.

The invention claimed is:

1. A lamp assembly, comprising: a lamp socket, comprising: a first socket portion defining a first cylindrical volume proximate to an open end of the lamp socket, the first cylindrical volume having a first diameter; and a second socket portion being concentric with the first socket portion and defining a second cylindrical volume distal from the open end of the lamp socket, the second cylindrical volume having a second diameter smaller than the first diameter.

2. The lamp assembly of claim 1, wherein the first and the second socket portions respectively comprise a threaded upper portion and a threaded lower portion of a cavity defined by a housing.

3. The lamp assembly of claim 2, further comprising a first electrical contact located at a bottom of the cavity, wherein the threaded upper portion comprises conductive internal threads or a conductive tab, the conductive internal threads or the conductive tab being a second electrical contact.

4. The lamp assembly of claim 1, wherein:

the first and the second socket portions respectively comprise a tall outer socket and a short inner socket concentrically seated on a socket base;

the tall outer socket comprising first conductive internal threads or a first conductive tab, the first conductive internal threads or the first conductive tab being a first electrical contact; and the short inner socket comprising second conductive internal threads or a second conductive tab, the second conductive internal threads or the second conductive tab being a second electrical contact.

5. The lamp assembly of claim 1, wherein:

the first and the second socket portions respectively comprise a tall outer socket and a short inner socket concentrically seated on a socket base;

the tall outer socket comprising conductive internal threads or a conductive tab, the conductive internal threads or the conductive tab being a first electrical contact; and the lamp socket further comprises a second electrical contact located on the socket base within the short inner socket.

6. The lamp assembly of claim 1, wherein the lamp socket comprises:

an Edison lamp socket comprising:

conductive internal threads being a first electrical contact;

a socket base; and a second electrical contact on the socket base; and an adapter ring screwed into the Edison lamp socket, the adapter ring comprising outer threads and defining a threaded hole exposing the second electrical contact.

7. The lamp assembly of claim 6, wherein the adapter ring comprises a tamper proof element on the outer threads of the adapter ring to prevent removal of the adapter ring from the Edison lamp socket.

8. The lamp assembly of claim 1, wherein the lamp socket comprises:

an Edison lamp socket comprising:

conductive internal threads being a first electrical contact;

a socket base; and a second electrical contact on the socket base; and an adapter screwed into the Edison lamp socket, the adapter comprising:

a ring comprising outer threads and defining a threaded hole exposing the second electrical contact; and a sleeve screwed into the ring, the sleeve comprising inner and outer threads.

9. The lamp assembly of claim 8, wherein the sleeve is conductive and comprises a top end that is open and a bottom end that is closed or has an extended portion to touch the second electrical contact of the Edison lamp socket.

10. The lamp assembly of claim 8, wherein the sleeve is nonconductive and has open ends to expose the second electrical contact of the Edison lamp socket.

11. The lamp assembly of claim 8, wherein the ring comprises a tamper proof element on the outer threads of the ring to prevent removal of the ring from the Edison lamp socket.

12. The lamp assembly of claim 1, further comprising:

a light bulb with an Edison screw base having a screw thread contact and an electrical foot contact; and an adapter, comprising:

a conductive, internally threaded socket-size sleeve screwed onto the Edison screw base;

a conductive, externally and internally threaded base-size sleeve screwed into the socket-size sleeve;

an insulator ring comprising outer threads and defining a threaded hole, the insulator ring being screwed into the base-size sleeve; and a conductive screw base screwed into the threaded hole, the screw base comprising a top end to touch the electrical foot contact of the Edison screw base.

13. The lamp assembly of claim 1, wherein the lamp socket comprises:

a conductive, internally and externally threaded outer sleeve, the outer sleeve forming the first socket portion;

a bottom base comprising inner threads and defining a threaded hole, the bottom base being screwed onto the outer sleeve, at least one of the inner threads and the bottom base being nonconductive;

a conductive, internally and externally threaded inner sleeve, the inner sleeve being screwed into the threaded hole of the bottom base, the inner sleeve forming the second socket portion; and a conductive, externally threaded center plug being screwed into the inner sleeve.

14. The lamp assembly of claim 13, wherein the lamp socket further comprises:

a nonconductive first T-shape sleeve comprising an internally threaded first lower portion, an internally threaded first upper portion, and a first ring between the first lower portion and the first upper portion, the first T-shape sleeve being screwed onto the outer sleeve;

a conductive, internally and externally threaded other outer sleeve, the other outer sleeve being screwed into the first T-shape sleeve, the first ring preventing the outer sleeve and the other outer sleeve from touching;

a nonconductive second T-shape sleeve comprising an internally threaded second lower portion, an internally threaded second upper portion, and a second ring between the second lower portion and the second upper portion, the second T-shape sleeve being screwed onto the inner sleeve; and a conductive, internally and externally threaded other inner sleeve, the other inner sleeve being screwed into the second T-shape sleeve, the second ring preventing the inner sleeve and the other inner sleeve from touching.

15. The lamp assembly of claim 1, further comprising:

a light bulb with a double screw base, comprising:

a conductive, internally and externally threaded outer sleeve, the outer sleeve forming an outer screw base;

a nonconductive top base comprising outer threads and defining a threaded hole, the top base being screwed into the outer sleeve; and a conductive, externally threaded inner sleeve screwed into the threaded hole of the top base, the inner sleeve having a closed bottom end, the inner sleeve forming an inner screw base.

16. The lamp assembly of claim 15, wherein the light bulb with the double screw base further comprises:

a nonconductive first T-shape sleeve comprising an externally threaded first lower portion, an externally threaded first upper portion, and a first ring between the first lower portion and the first upper portion, the first T-shape sleeve being screwed into the inner sleeve;

a conductive, internally and externally threaded other inner sleeve, the other inner sleeve being screwed onto the first T-shape sleeve, the first ring preventing the inner sleeve and the other inner sleeve from touching;

a nonconductive second T-shape sleeve comprising an externally threaded second lower portion, an externally threaded second upper portion, and a second ring between the second lower portion and the second upper portion, the second T-shape sleeve being screwed into the outer sleeve; and a conductive, internally and externally threaded other outer sleeve, the other outer sleeve being screwed onto the second T-shape sleeve, the second ring preventing the outer sleeve and the other outer sleeve from touching.

17. An Edison lamp socket, comprising:

a cup-shape bottom base comprising an internally threaded sidewall and a bottom defining a threaded hole, at least one of the sidewall and the bottom being nonconductive;

a conductive, internally and externally threaded sleeve, the sleeve being screwed into the bottom base; and a conductive, externally threaded center plug, the center plug being screwed into the threaded hole.

18. An Edison screw base, comprising:

a nonconductive base comprising external threads and defining a threaded hole;

a conductive threaded sleeve with outer threads and inner threads, the sleeve being screwed onto the base; and a conductive, externally threaded center plug, the center plug being screwed into the threaded hole.

* * * * *